US008345069B2

(12) United States Patent
Minami et al.

(10) Patent No.: US 8,345,069 B2
(45) Date of Patent: Jan. 1, 2013

(54) DISPLAY APPARATUS, DRIVING METHOD FOR DISPLAY APPARATUS AND ELECTRONIC APPARATUS

(75) Inventors: Tetsuo Minami, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 758 days.

(21) Appl. No.: 12/453,906

(22) Filed: May 27, 2009

(65) Prior Publication Data

US 2009/0315918 A1 Dec. 24, 2009

(30) Foreign Application Priority Data

Jun. 23, 2008 (JP) ..... 2008-162738

(51) Int. Cl.
*G09G 5/10* (2006.01)

(52) U.S. Cl. ..... 345/690

(58) Field of Classification Search ..... 345/76–87, 345/204, 207–212, 690; 315/169.1–169.3, 315/291, 307; 324/760.01, 760.02
See application file for complete search history.

(56) References Cited

U.S. PATENT DOCUMENTS

| | | | | |
|---|---|---|---|---|
| 4,398,342 | A * | 8/1983 | Pitt et al. | 438/3 |
| 7,545,349 | B2 * | 6/2009 | Yamada | 345/76 |
| 7,623,113 | B2 * | 11/2009 | Zhou et al. | 345/107 |
| 7,911,464 | B2 * | 3/2011 | Childs et al. | 345/214 |
| 7,918,808 | B2 * | 4/2011 | Simmons | 600/590 |
| 7,948,456 | B2 * | 5/2011 | Yamashita et al. | 345/82 |
| 7,986,098 | B2 * | 7/2011 | Tada et al. | 315/169.3 |
| 2004/0041760 | A1 * | 3/2004 | Tsumura et al. | 345/87 |
| 2004/0041778 | A1 * | 3/2004 | Hiraki et al. | 345/100 |
| 2005/0007357 | A1 * | 1/2005 | Yamashita et al. | 345/204 |
| 2005/0057580 | A1 * | 3/2005 | Yamano et al. | 345/690 |
| 2005/0180083 | A1 * | 8/2005 | Takahara et al. | 361/152 |
| 2005/0212732 | A1 * | 9/2005 | Aoki | 345/76 |
| 2005/0269959 | A1 * | 12/2005 | Uchino et al. | 315/169.3 |
| 2006/0170628 | A1 * | 8/2006 | Yamashita et al. | 345/76 |
| 2007/0080905 | A1 * | 4/2007 | Takahara | 345/76 |
| 2007/0115224 | A1 * | 5/2007 | Yamamoto et al. | 345/76 |
| 2008/0111773 | A1 * | 5/2008 | Tsuge | 345/76 |
| 2009/0201231 | A1 * | 8/2009 | Takahara et al. | 345/76 |

FOREIGN PATENT DOCUMENTS

| | | |
|---|---|---|
| JP | 2006-106786 A | 4/2006 |
| JP | 2006-133542 | 5/2006 |
| JP | 2008-026468 A | 2/2008 |

OTHER PUBLICATIONS

Japanese Office Action issued Jun. 22, 2010 for corresponding Japanese Application No. 2008-162738.

* cited by examiner

*Primary Examiner* — Prabodh M Dharia
(74) *Attorney, Agent, or Firm* — Rader Fishman & Grauer, PLLC

(57) ABSTRACT

Disclosed herein is a display apparatus, including: a display panel having a plurality of pixels arranged in a matrix thereon, each of the pixels including an electro-optical element, a writing transistor, a driving transistor, and a storage capacitor connected between the gate electrode and the source electrode of the driving transistor for storing an image signal written by the writing transistor, each of the pixels carrying out a mobility correction process for applying negative feedback to a potential difference between the gate and the source of the driving transistor with a correction amount determined from current flowing to the driving transistor; a temperature detection section configured to detect the temperature of the display panel; and a control section configured to control the period of the mobility correction process based on a result of the detection by the temperature detection section.

12 Claims, 19 Drawing Sheets

THRESHOLD VALUE CORRECTION: NO,
MOBILITY CORRECTION: NO

THRESHOLD VALUE CORRECTION: YES,
MOBILITY CORRECTION: NO

THRESHOLD VALUE CORRECTION: YES,
MOBILITY CORRECTION: YES

| PANEL TEMPERATURE | PULSE WIDTH OF WSEN2 |
|---|---|
| 0℃ | C1 |
| 10℃ | C2 |
| 25℃ | C0 |
| 40℃ | C3 |
| 60℃ | C4 |
| 80℃ | C5 |

DISPLAY APPARATUS, DRIVING METHOD FOR DISPLAY APPARATUS AND ELECTRONIC APPARATUS

BACKGROUND OF THE INVENTION

1. Field of the Invention

This invention relates to a display apparatus, a driving method for a display apparatus and an electronic apparatus, and more particularly to a display apparatus of the flat type or flat panel type wherein a plurality of pixels are arranged two-dimensionally in a matrix, a driving method for the display apparatus and an electronic apparatus which incorporates the display apparatus.

2. Description of the Related Art

In recent years, in the field of display apparatus which display an image, a flat type display apparatus wherein a plurality of pixels or pixel circuits are arranged in a matrix, that is, in rows and columns, has been popularized rapidly. One of such flat type display apparatus uses, as a light emitting element of a pixel, an electro-optical element of the current driven type whose emitted light luminance varies in response to the value of current flowing through the element. As the electro-optical element of the current driven type, an organic EL (Electro Luminescence) element which utilizes a phenomenon that an organic thin film emits light when an electric field is applied thereto is known.

An organic EL display apparatus which uses an organic EL element as an electro-optical element of a pixel has the following characteristics. In particular, the organic EL element has a low-power consumption characteristic because it can be driven by an application voltage equal to or lower than 10 V. Since the organic EL element is a self luminous element, it displays an image of high visibility in comparison with a liquid crystal display apparatus which displays an image by controlling the intensity of light from a light source using liquid crystal for each pixel. Besides since the organic EL element does not require an illuminating member such as a backlight, it facilitates reduction in weight and thickness of the organic EL display apparatus. Further, since the speed of response is as high as approximately several μsec, an afterimage upon dynamic picture display does not appear.

The organic EL display apparatus can adopt a simple or passive matrix type or an active matrix type as a driving method therefor similarly to the liquid crystal display apparatus. However, although the display apparatus of the simple matrix type is simple in structure, it has a problem in that it is difficult to implement the same as a large-sized high definition display apparatus because the light emitting period of each electro-optical element decreases as the number of scanning lines, that is, the number of pixels, increases.

Therefore, in recent years, development of an active matrix display apparatus wherein the current to flow through an electro-optical element is controlled by an active element provided in a pixel in which the electro-optical element is provided such as an insulated gate type field effect transistor has been and is being carried out vigorously. As the insulated gate type field effect transistor, usually a thin film transistor (TFT) is used. The active matrix display apparatus can be easily implemented as a large-sized and high definition display apparatus because the electro-optical element continues to emit light over a period of one frame.

Incidentally, it is generally known that the I-V characteristic, that is, the current-voltage characteristic, of the organic EL element deteriorates as time passes (aged deterioration). In a pixel circuit which uses a TFT particularly of the N channel type as a transistor (hereinafter referred to as driving transistor) for driving the organic EL element by current, if the I-V characteristic of the organic EL element suffers from aged deterioration, then the gate-source voltage Vgs of the driving transistor varies. As a result, the luminance of emitted light of the organic EL element varies. This arises from the fact that the organic EL element is connected to the source electrode side of the driving transistor.

This is described more particularly. The source potential of the driving transistor depends upon the operating point of the driving transistor and the organic EL element. Then, if the I-V characteristic of the organic EL element deteriorates, then since the operating point of the driving transistor and the organic EL element varies, even if the same voltage is applied to the gate electrode of the driving transistor, the source potential of the driving transistor changes. Consequently, the source-gate voltage Vgs of the driving transistor varies and the value of current flowing to the driving transistor changes. As a result, since also the value of current flowing to the organic EL element varies, the emitted light luminance of the organic EL element varies.

Further, particularly in a pixel circuit which uses a polycrystalline silicon TFT, in addition to the aged deterioration of the I-V characteristic of the organic EL element, a transistor characteristic of the driving transistor varies as time passes or a transistor characteristic differs among different pixels due to a dispersion in the fabrication process. In other words, a transistor characteristic of the driving transistor disperses among individual pixels. The transistor characteristic may be a threshold voltage Vth of the driving transistor, the mobility μ of a semiconductor thin film which forms the channel of the driving transistor (such mobility μ is hereinafter referred to simply as "mobility μ of the driving transistor") or some other characteristic.

Where a transistor characteristic of the driving transistor differs among different pixels, since this gives rise to a dispersion of the value of current flowing to the driving transistor among the pixels, even if the same voltage is applied to the gate electrode of the driving transistor among the pixels, a dispersion appears in the emitted light luminance of the organic EL element among the pixels. As a result, the uniformity of the screen image is damaged.

Therefore, various correction or compensation functions are provided to a pixel circuit in order to keep the emitted light luminance of the organic EL element fixed without being influenced by aged deterioration of the I-V characteristic of the organic EL element or aged deterioration of a transistor characteristic of the driving transistor as disclosed, for example, in Japanese Patent Laid-Open No. 2006-133542.

The correction functions may include a compensation function for a characteristic variation of the organic EL element, a correction function against the variation of the threshold voltage Vth of the driving transistor, a correction function against the variation of the mobility μ of the driving transistor and some other functions. In the description given below, the correction against the variation of the threshold voltage Vth of the driving transistor is referred to as "threshold value correction," and the correction against the mobility μ of the driving transistor is referred to as "mobility correction."

Where each pixel circuit is provided with various correction functions in this manner, the emitted light luminance of the organic EL element can be kept fixed without being influenced by aged deterioration of the I-V characteristic of the organic EL element or aged deterioration of a transistor characteristic of the driving transistor. As a result, the display quality of the organic EL display apparatus can be improved.

The compensation function for a characteristic variation of the organic EL element is executed by such a series of circuit operations as described below. First, an image signal supplied through a signal line is written by a writing transistor so as to be stored into a storage capacitor connected between the gate and the source of the driving transistor. Thereafter, the writing transistor is placed into a non-conducting state to electrically disconnect the gate electrode of the driving transistor from the signal line to place the gage electrode of the driving transistor into a floating state.

When the gate electrode of the driving transistor is placed into a floating state, since the storage capacitor is connected between the gate and the source of the driving transistor, also the gate potential Vg of the driving transistor varies in an interlocking relationship with, that is, following up, the variation of the source potential Vs of the driving transistor. An operation for varying the gate potential Vg in an interlocking relationship with the source potential Vs of the driving transistor in this manner is hereinafter referred to as bootstrap operation. By this bootstrap operation, the gate-source voltage Vgs of the driving transistor can be kept fixed. As a result, even if the I-V characteristic of the organic EL element suffers from aged deterioration, the emitted light luminance of the organic EL element can be kept fixed.

SUMMARY OF THE INVENTION

Incidentally, the emitted light luminance of a display panel wherein a plurality of pixels are arranged two-dimensionally in a matrix exhibits a higher level in a high temperature state than in a normal temperature state with respect to the same signal voltage. FIG. 25 illustrates a V (signal voltage)–L (emitted light luminance) characteristic of a display panel. That the V–L characteristic of a display panel has a temperature-dependency in this manner arises from a temperature characteristic of an electro-optical element such as an organic EL element.

FIG. 26 illustrates a temperature characteristic of an organic EL element. More particularly, FIG. 26 illustrates an EL application voltage-current density characteristic of a broken line curve where the ambient temperature is normal temperature or room temperature of, for example, 25° C. and another EL application voltage-current density characteristic of a solid line curve in a high ambient temperature state of, for example, 60° C. From this temperature characteristic, it can be recognized that, if the ambient temperature becomes a high temperature state, then since the rising edge of the characteristic curve becomes steeper, the driving voltage of the organic EL element, that is, the EL application voltage, drops from that in a normal temperature state.

The current flowing to the organic EL element, that is, the current flowing through the driving transistor, or in other words, the drain-source current Ids of the driving transistor, is represented by the following expression (10):

$$Ids=k\mu(Vgs-(1-Gb)\times\Delta Vs)^2 \quad (10)$$

where Vgs is the gate-source voltage of the driving transistor, and ΔVs the variation of the source voltage Vs of the driving transistor. The constant k is (1/2)(W/L)Cox, where W is the channel width of the driving transistor, L the channel length, and Cox the gate capacitance per unit area.

Further, Gb represents the bootstrap gain. The bootstrap gain Gb is the ratio of the variation ΔVg of the gate potential Vg to the variation ΔVs of the source potential Vs of the driving transistor in the bootstrap operation described above, and is represented by ΔVg/ΔVs. This bootstrap gain Gb depends upon the capacitance value of the storage capacitor, the capacitance value of parasitic capacitance provided by the gate of the driving transistor and so forth.

If the temperature of the display panel rises and the driving voltage for the organic EL element drops, then the variation amount ΔVs of the source potential Vs of the driving transistor decreases. Consequently, since the current Ids flowing through the driving transistor increases as can be recognized apparently from the expression (10) given hereinabove, also the current flowing through the organic EL element increases and the emitted light luminance increases. In short, if the temperature becomes high from normal temperature, then the luminance of the organic EL element becomes excessively high under the same driving voltage.

In this manner, the organic EL element has a problem that, since it has a temperature characteristic, if the panel temperature rises due to a rise of the ambient temperature or the like, then the current flowing to the organic EL element increases and, as a result, the emitted light luminance of the display panel becomes higher than that in a normal temperature state. On the contrary, if the panel temperature drops, then since the current flowing to the organic EL element decreases, the emitted light luminance of the display panel becomes lower than that in a normal temperature state.

Therefore, it is desirable to provide a display apparatus wherein the emitted light luminance of a display panel can be kept fixed without being influenced by a variation of the temperature of the display panel, a suitable driving method for the display apparatus and an electronic apparatus which incorporates the display apparatus.

According to an embodiment of the present invention, there is provided a display apparatus including a display panel having a plurality of pixels arranged in a matrix thereon, each of the pixels including an electro-optical element, a writing transistor for writing an image signal, a driving transistor for driving the electro-optical element in response to the image signal written by the writing transistor, and a storage capacitor connected between the gate electrode and the source electrode of the driving transistor for storing the image signal written by the writing transistor, each of the pixels carrying out a mobility correction process for applying negative feedback to a potential difference between the gate and the source of the driving transistor with a correction amount determined from current flowing to the driving transistor, a temperature detection section configured to detect the temperature of the display panel, and a control section configured to control the period of the mobility correction process based on a result of the detection by the temperature detection section.

If the electro-optical element has a temperature characteristic and the temperature of the display panel on which the electro-optical element is disposed, for example, rises, then the driving voltage of the electro-optical element drops and the variation of the source potential of the driving transistor decreases. Consequently, the current flowing to the driving transistor increases and the current flowing to the electro-optical element increases, and therefore, the emitted light luminance increases. At this time, the period for the mobility correction process (such period is hereinafter referred to as "mobility correction period") is controlled based on a result of the detection of the temperature of the display panel. In particular, when the temperature of the display panel is higher than normal temperature, the mobility correction period is adjusted so as to increase.

When the mobility correction period increases, the negative feedback is applied for a longer period of time than that before the mobility correction period with respect to the potential difference between the gate and the source of the driving transistor. Consequently, the feedback amount in the mobility correction process increases from that in a case wherein the mobility correction period is initialized, that is, before the mobility correction period is adjusted. Therefore, the mobility correction process is carried out in a direction in which the emitted light luminance is lowered. As a result, the variation of the emitted light luminance arising from a variation, here a rise, of the temperature of the display panel is suppressed.

With the display apparatus, since the variation of the emitted light luminance arising from a temperature variation of the display panel is suppressed, the emitted light luminance of the display panel can be kept fixed without being influenced by a variation of the temperature of the display panel. Therefore, a good display image can be obtained.

The above and other features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENT

System Configuration

Figure 1:
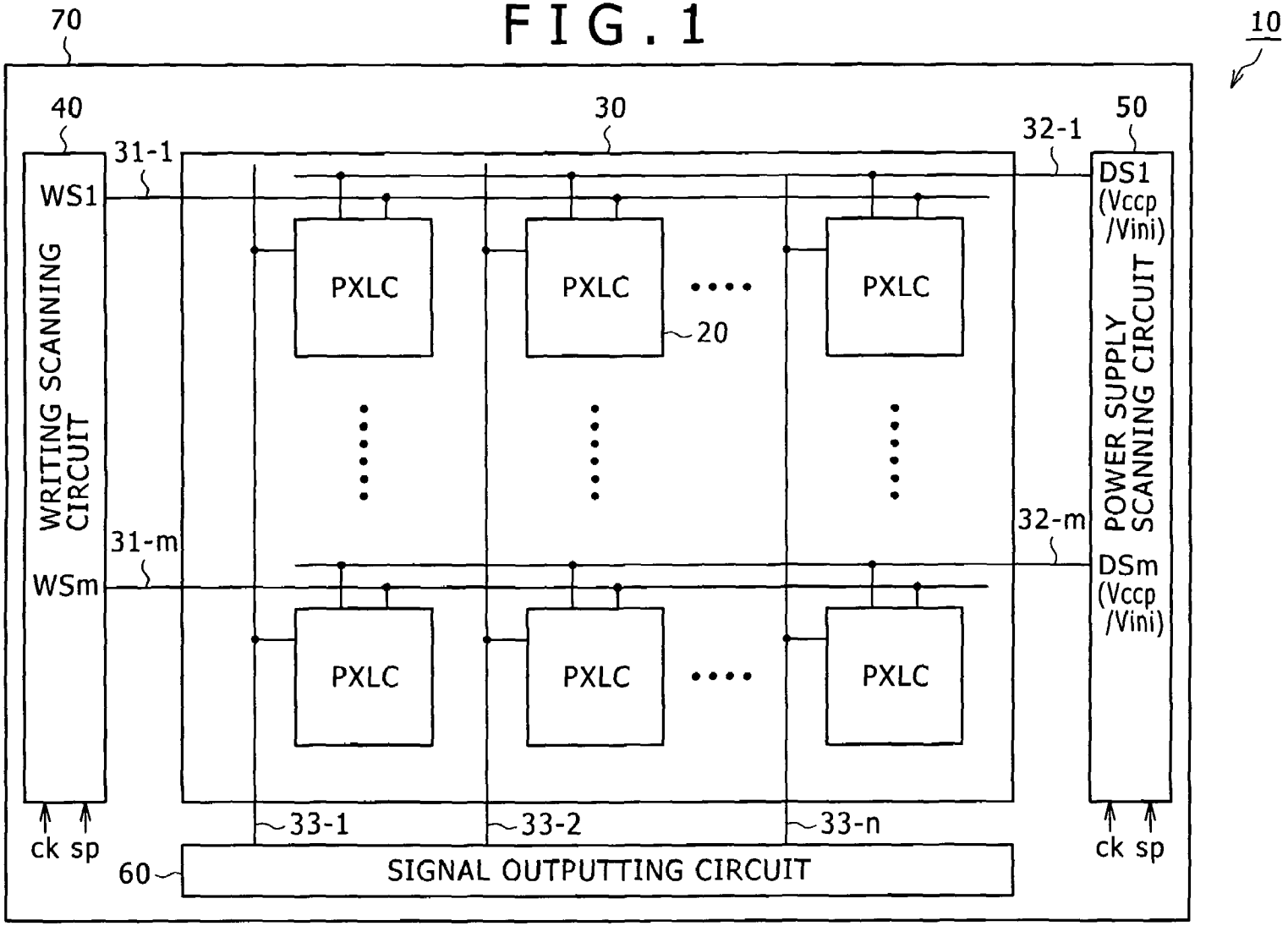
FIG. 1 is a block diagram showing a general system configuration of an organic EL display apparatus to which an embodiment of the present invention is applied.

FIG. 1 is a block diagram showing a general system configuration of an active matrix display apparatus to which an embodiment of the present invention is applied. Here, it is assumed that the active matrix display apparatus described is an active matrix organic EL display apparatus wherein an organic EL element which is an electro-optical element of the current driven type whose emitted light luminance varies in response the value of current flowing through the element is used as a light emitting element of a pixel or pixel circuit.

Referring to FIG. 1, the organic EL display apparatus 10 shown includes a plurality of pixels 20 each including a light emitting element, a pixel array section 30 in which the pixels 20 are arranged two-dimensionally in rows and columns, that is, in a matrix, and driving sections disposed around the pixel array section 30. The driving sections drive the pixels 20 of the pixel array section 30. The driving sections include a writing scanning circuit 40, a power supply scanning circuit 50 and a signal outputting circuit 60.

Here, if the organic EL display apparatus 10 is ready for white/black display, then one pixel which makes a unit for forming a monochromatic image corresponds to a pixel 20. On the other hand, where the organic EL display apparatus 10 is ready for color display, one pixel which makes a unit for forming a color image is formed from a plurality of sub pixels, each of which corresponds to a pixel 20. More particularly, in a display apparatus for color display, one pixel is composed of a sub pixel for emitting red light (R), another sub pixel for emitting green light (G) and a further sub pixel for emitting blue right (B).

However, one pixel is not necessarily formed from a combination of sub pixels of the three primary colors of R, G and B but may be formed from one or a plurality of sub pixels of a color or different colors in addition to the sub pixels of the three primary colors. In particular, for example, a sub pixel for emitting white light (W) may be added to form one pixel in order to raise the luminance, or at least one sub pixel for emitting light of a complementary color may be added to form one pixel in order to expand the color reproduction range.

The pixels 20 are arrayed in m rows and n columns in the pixel array section 30, and scanning lines 31-1 to **31-*m* and power supply lines 32-1 to 32-*m* are wired for the individual pixel rows along the direction of a row, that is, along the direction along which the pixels in a pixel row are arranged. Further, signal lines 33-1 to 33-*n*** are wired for the individual pixel columns along the direction of a column, that is, along the direction along which the pixels in a pixel column are arranged.

The scanning lines 31-1 to **31-*m* are individually connected to output terminals of the writing scanning circuit 40 for the corresponding rows. The power supply lines 32-1 to 32-*m* are individually connected to output terminals of the power supply scanning circuit 50 for the corresponding rows. The signal lines 33-1 to 33-*n* are individually connected to output terminals of the signal outputting circuit 60** for the corresponding columns.

The pixel array section 30 is normally formed on a transparent insulating substrate such as a glass substrate. Consequently, the organic EL display apparatus 10 has a flat panel structure. A driving circuit for each of the pixels 20 of the pixel array section 30 can be formed using an amorphous silicon TFT (Thin Film Transistor) or a low temperature polycrystalline silicon TFT. Where a low temperature polycrystalline silicon TFT is used, also the writing scanning circuit 40, power supply scanning circuit 50 and signal outputting circuit 60 can be mounted on a display panel or substrate 70 which forms the pixel array section 30.

The writing scanning circuit 40 is formed from a shift register which successively shifts a start pulse sp in synchronism with a clock pulse ck or from a like element. Upon writing of an image signal into the pixel 20 in the pixel array section 30, the writing scanning circuit 40 successively supplies a writing scanning signal WS (WS1 to WSm) to the scanning lines 31-1 to **31-*m* to successively scan (line sequential scanning) the pixels 20 of the pixel array section 30** in a unit of a row.

The power supply scanning circuit 50 is formed from a shift register which successively shifts the start pulse sp in synchronism with the clock pulse ck or from a like element. The power supply scanning circuit 50 supplies a power supply potential DS (DS1 to DSm), which changes over between a first power supply potential Vccp and a second power supply potential Vini lower than the first power supply potential Vccp, to the power supply lines 32-1 to **32-*m* in synchronism with line sequential scanning by the writing scanning circuit 40. By the changeover of the power supply potential DS between the first power supply potential Vccp and the second power supply potential Vini, control of light emission/no-light emission of the pixels 20** is carried out.

The signal outputting circuit 60 selects one of a signal voltage Vsig of an image signal representative of luminance information supplied from a signal supply line not shown and a reference potential Vofs and outputs the selected voltage. The signal voltage Vsig or reference potential Vofs outputted from the signal outputting circuit 60 is written into the pixels 20 of the pixel array section 30 in a unit of a column through the signal lines 33-1 to **33-*n*. In other words, the signal outputting circuit 60** has a line sequential writing driving form wherein the signal voltage Vsig is written in a unit of a column or line.

Pixel Circuit

Figure 2:
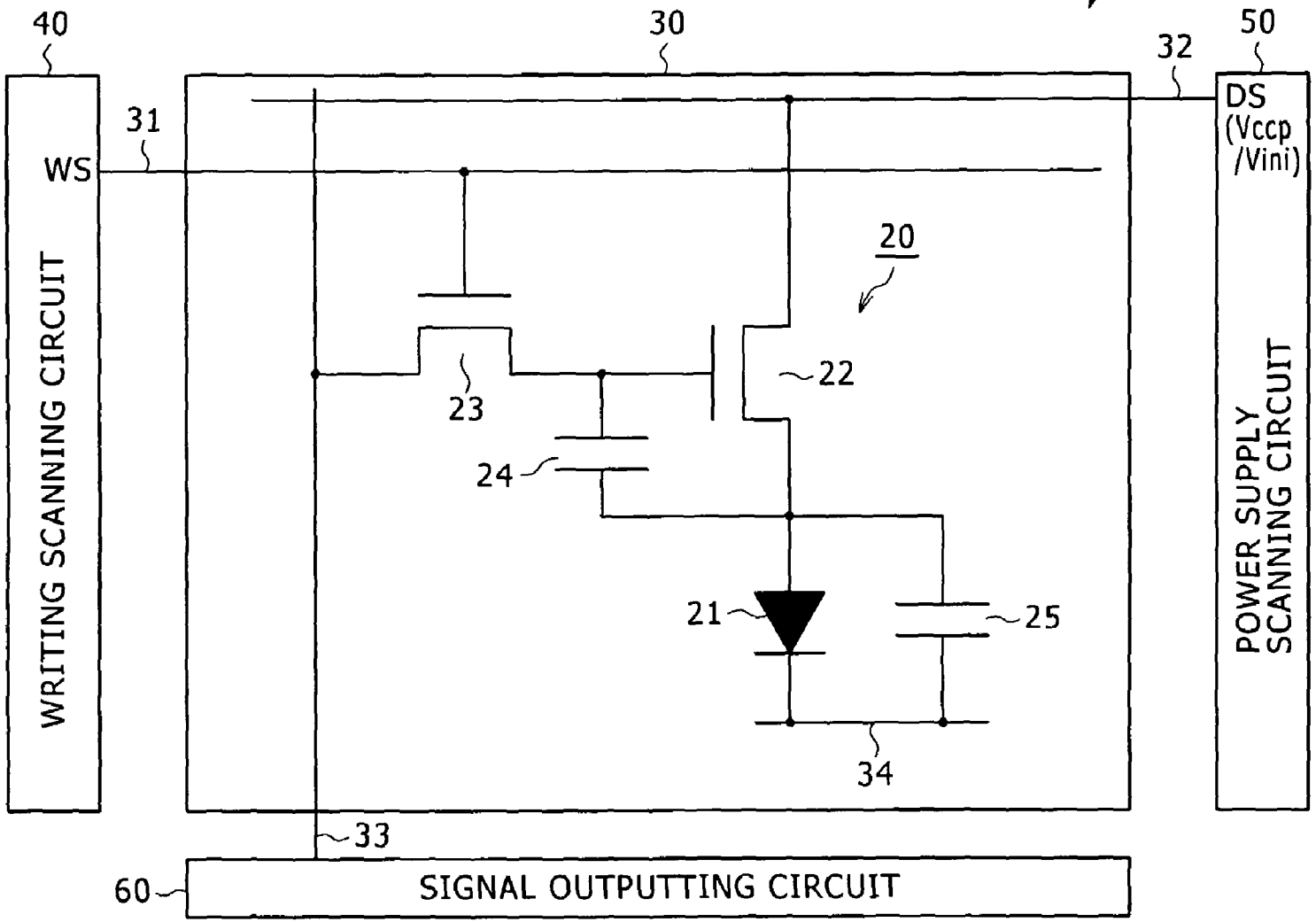
FIG. 2 is a block circuit diagram showing a circuit configuration of a pixel.

FIG. 2 shows a particular circuit configuration of a pixel or pixel circuit 20.

Referring to FIG. 2, the pixel 20 includes an electro-optical element of the current driven type whose emitted light luminance varies in response to the value of current flowing therethrough such as an organic EL element 21, and a driving circuit for driving the organic EL element 21. The organic EL element 21 is connected at the cathode electrode thereof to a common power supply line 34 which is wired commonly to all pixels 20.

The driving circuit for driving the organic EL element 21 includes a driving transistor 22, a writing transistor 23, a storage capacitor 24 and an auxiliary capacitor 25. Here, an N-channel TFT is used for the driving transistor 22 and the writing transistor 23. However, this combination of the conduction types of the driving transistor 22 and the writing transistor 23 is a mere example, and the combination of such conduction types is not limited to this specific combination.

It is to be noted that, where an N-channel TFT is used for the driving transistor 22 and the writing transistor 23, an amorphous silicon (a-Si) process can be used for the fabrication of them. Where the a-Si process is used, reduction of the cost of a substrate on which the TFTs are to be produced and reduction of the cost of the organic EL display apparatus 10 can be anticipated. Further, if the driving transistor 22 and the writing transistor 23 are formed in a combination of the same conduction type, then since the transistors 22 and 23 can be produced by the same process, this can contribute to reduction of the cost.

The driving transistor 22 is connected at a first electrode thereof, that is, at the source/drain electrode thereof, to the anode electrode of the organic EL element 21 and at a second electrode thereof, that is, at the drain/source electrode thereof, to a power supply line 32 (32-1 to **32-*m***).

The writing transistor 23 is connected at a first electrode thereof, that is, at the source/drain electrode thereof, to a signal line 33 (33-1 to **33-*n*) and at a second electrode thereof, that is, at the drain/source electrode thereof, to the gate electrode of the driving transistor 22. Further, the writing transistor 23 is connected at the gate electrode thereof to a scanning line 31 (31-1 to 31-*m***).

In the driving transistor 22 and the writing transistor 23, the first electrode is a metal line electrically connected to the source/drain region, and the second electrode is a metal line electrically connected to the drain/source region. Further, depending upon the relationship of the potential between the first electrode and the second electrode, the first electrode may be the source electrode or the drain electrode, and the second electrode may be the drain electrode or the source electrode.

The storage capacitor 24 is connected at an electrode thereof to the gate electrode of the driving transistor 22 and at the other electrode thereof to the first electrode of the driving transistor 22 and the anode electrode of the organic EL element 21.

The auxiliary capacitor 25 is connected at an electrode thereof to the anode electrode of the organic EL element 21 and at the other electrode thereof to the common power supply line 34. The auxiliary capacitor 25 is provided as occasion demands in order to make up for shortage of the capacitance of the organic EL element 21 to raise the writing gain of an image signal into the storage capacitor 24. In other words, the auxiliary capacitor 25 is not an essentially required element but may be omitted where the equivalent capacitance of the organic EL element 21 is sufficiently high.

It is to be noted here that, while the auxiliary capacitor 25 is connected at the other electrode thereof to the common power supply line 34, the connection destination of the other electrode is not limited to the common power supply line 34, but may be any node of a fixed potential. Where the auxiliary capacitor 25 is connected at the other electrode thereof to a fixed potential, an initial purpose of making up for the shortage of the capacitance of the organic EL element 21 to raise the writing gain of an image signal into the storage capacitor 24 can be achieved.

In the pixel 20 having the configuration described above, the writing transistor 23 is placed into a conducting state in response to a High-active writing scanning signal WS applied to the gate electrode of the writing transistor 23 through the scanning line 31 from the writing scanning circuit 40. Consequently, the writing transistor 23 samples the signal voltage Vsig of an image signal representative of luminance information or the reference potential Vofs supplied from the signal outputting circuit 60 through the signal line 33 and writes the sampled potential into the pixel 20. The thus written signal voltage Vsig or reference potential Vofs is applied to the gate electrode of the driving transistor 22 and stored into the storage capacitor 24.

The driving transistor 22 operates, when the power supply potential DS of the power supply line 32 (32-1 to **32-*m*) is the first power supply potential Vccp, in a saturation region while the first electrode serves as the drain electrode and the second electrode serves as the source electrode. Consequently, the driving transistor 22 receives supply of current from the power supply line 32 and drives the organic EL element 21 by current driving to emit light. More particularly, the driving transistor 22 operates in a saturation region thereof to supply driving current of a current value corresponding to the voltage value of the signal voltage Vsig stored in the storage capacitor 24 to the organic EL element 21 to drive the organic EL element 21** with the current so as to emit light.

Further, when the power supply potential DS changes over from the first power supply potential Vccp to the second power supply potential Vini, the first electrode of the driving transistor 22 serves as the source electrode while the second electrode of the driving transistor 22 serves as the drain electrode, and the driving transistor 22 operates as a switching transistor. Consequently, the driving transistor 22 stops supply of driving current to the organic EL element 21 to place the organic EL element 21 into a no-light emitting state. Thus, the driving transistor 22 has a function also as a transistor for controlling light emission/no-light mission of the organic EL element 21.

The switching operation of the driving transistor 22 provides a period within which the organic EL element 21 is in a no-light emitting state, that is, a no-light emitting period and controls the ratio between the light emitting period and the no-light emitting period of the organic EL element 21, that is, the duty of the organic EL element 21. By this duty control, after-image blurring caused by emission of light from a pixel over a one-frame period can be reduced, and consequently, the picture quality particularly of a dynamic picture can be enhanced.

Here, the reference potential Vofs selectively supplied from the signal outputting circuit 60 to the signal line 33 is used as a reference for the signal voltage Vsig of the image signal representative of luminance information, for example, as a potential which corresponds to the black level of the image signal.

The first power supply potential Vccp from between the first and second power supply potentials Vccp and Vini selectively supplied from the power supply scanning circuit 50 through the power supply line 32 is a power supply potential for supplying driving current for driving the organic EL element 21 to emit light to the driving transistor 22. Meanwhile, the second power supply potential Vini is used to apply a reverse bias to the organic EL element 21. This second power supply potential Vini is set to a potential lower than the reference potential Vofs, for example, to a potential lower than Vofs−Vth where Vth is a threshold voltage of the driving transistor 22, preferably to a potential sufficiently lower than Vofs−Vth.

Pixel Structure

Figure 3:
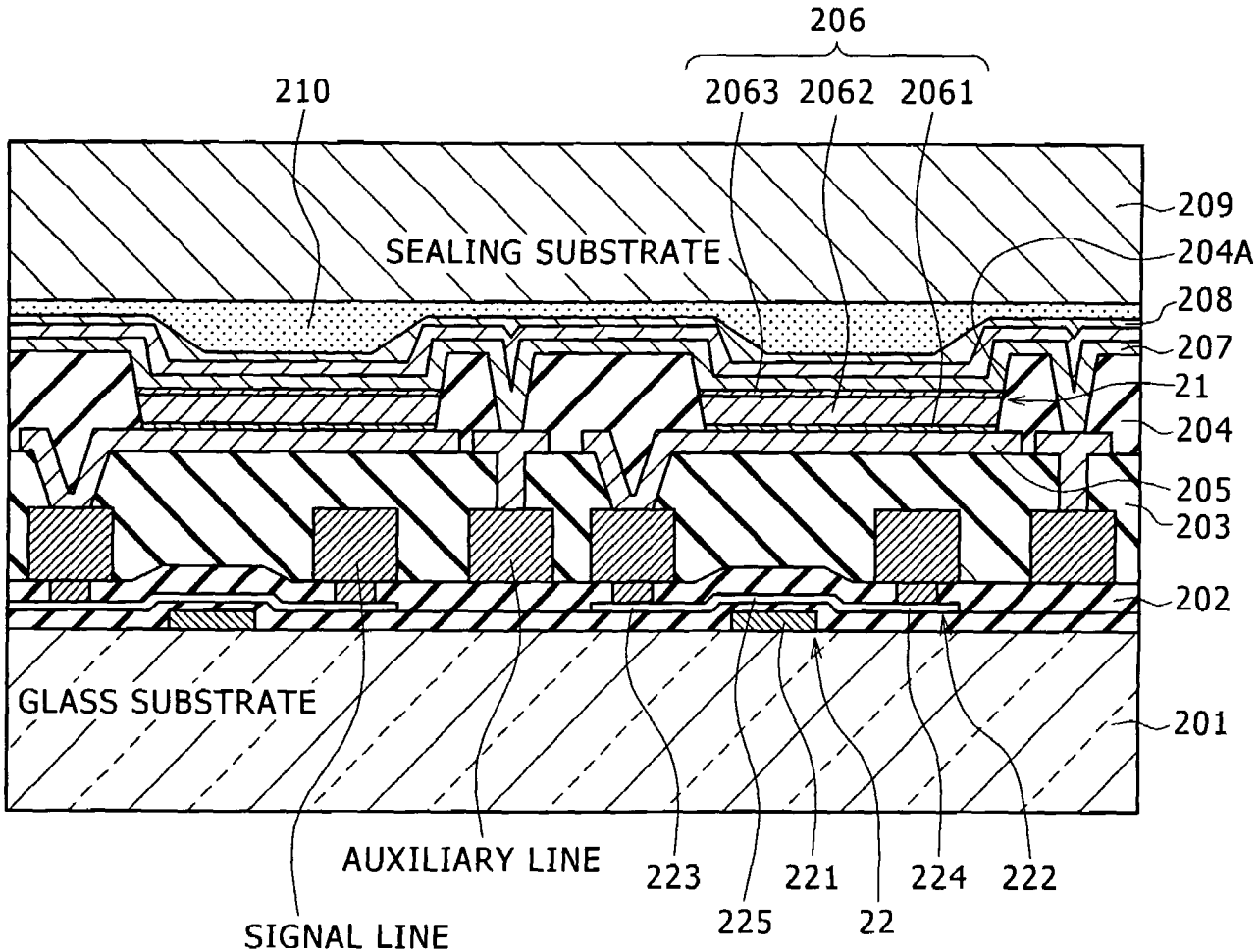
FIG. 3 is a sectional view showing an example of a sectional structure of a pixel.

FIG. 3 shows a sectional structure of a pixel 20. Referring to FIG. 3, a driving circuit including a driving transistor 22 and so forth is formed on a glass substrate 201. The pixel 20 is configured such that an insulating film 202, an insulating flattening film 203 and a window insulating film 204 are formed in order on the glass substrate 201 and an organic EL element 21 is provided at a recessed portion 204A of the window insulating film 204. Here, from among the components of the driving circuit, only the driving transistor 22 is shown while the other components are omitted.

The organic EL element 21 is formed from an anode electrode 205, an organic layer (electron transport layer, light emitting layer and hole transport layer/hole injection layer) 206, and a cathode electrode 207. The anode electrode 205 is made of metal or the like formed on the bottom of the recessed portion 204A of the window insulating film 204. The organic layer 206 is formed on the anode electrode 205. The cathode electrode 207 is formed from a transparent conductive film or the like formed commonly to all pixels on the organic layer 206.

In the organic EL element 21, the organic layer 206 is formed from a hole transport layer/hole injection layer 2061, a light emitting layer 2062, an electron transport layer 2063 and an electron injection layer (not shown) deposited in order on the anode electrode 205. If current flows from the driving transistor 22 to the organic layer 206 through the anode electrode 205 under the current driving by the driving transistor 22, then electrons and holes are recombined in the light emitting layer 2062 in the organic layer 206, whereupon light is emitted from the light emitting layer 2062.

The driving transistor 22 includes a gate electrode 221, source/drain regions 223 and 224 provided on the opposite sides of the gate electrode 221 on a semiconductor layer 222, and a channel formation region 225 at a portion of the semiconductor layer 222 opposing to the gate electrode 221. The source/drain region 223 is electrically connected to the anode electrode 205 of the organic EL element 21 through a contact hole.

After the organic EL element 21 is formed in a unit of a pixel on the glass substrate 201 through the insulating film 202, insulating flattening film 203 and window insulating film 204, a sealing substrate 209 is adhered through a passivation film 208 by a bonding agent 210. The organic EL element 21 is sealed with the sealing substrate 209 to form the display panel 70.

Circuit Operation of the Organic EL Display Apparatus

Now, circuit operation of the organic EL display apparatus 10 wherein the pixels 20 having the configuration described above are arranged two-dimensionally is described with reference to FIGS. 5A to 5D and 6A to 6D in addition to FIG. 4. It is to be noted that, in FIGS. 5A to 6D, the writing transistor 23 is represented by a symbol of a switch for simplified illustration.

Figure 4:
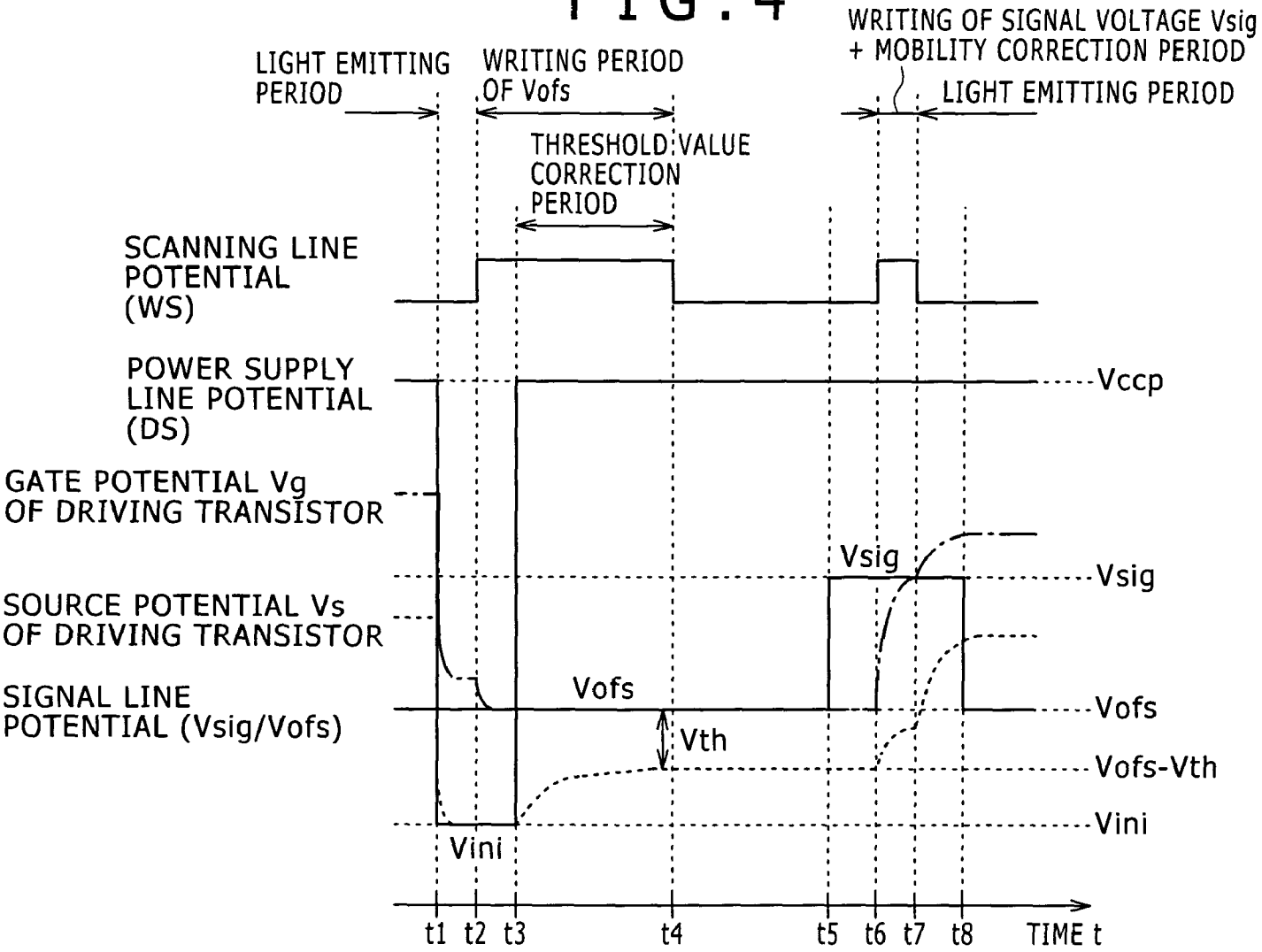
FIG. 4 is a timing waveform diagram illustrating circuit operation of the organic EL display apparatus of FIG. 1.

In FIG. 4, a variation of the potential (writing scanning signal) WS of a scanning line 31 (31-1 to **31-*m*), a variation of the potential (power supply potential) DS of a power supply line 32 (32-1 to 32-*m*) and variations of the gate potential Vg and the source potential Vs of the driving transistor 22**. Further, the waveform of the gate potential Vg is indicated by an alternate long and short dash line while the waveform of the source potential Vs is indicated by a broken line so that they can be identified from each other.

<Light Emitting Period within the Preceding Frame>

In FIG. 4, prior to time t1, a light emitting period of the organic EL element 21 within the preceding frame or field is provided. Within the light emitting period of the preceding frame, the power supply potential DS of the power supply line 32 has a first power supply potential (hereinafter referred to as "high potential") Vccp and the writing transistor 23 is in a non-conductive state.

The driving transistor 22 is set such that, at this time, it operates in a saturation region. Consequently, driving current or drain-source current Ids corresponding the gate-source voltage Vgs of the driving transistor 22 is supplied from the power supply line 32 to the organic EL element 21 through the driving transistor 22. Consequently, the organic EL element 21 emits light with a luminance corresponding to the current value of the driving current Ids.

<Threshold Value Correction Preparation Period>

At time t1, a new frame of line sequential scanning, that is, a current frame, is entered. Then, the potential DS of the power supply line 32 changes over from the high potential Vccp to a second power supply voltage (hereinafter referred to as "low potential") Vini, which is sufficiently lower than Vofs−Vth, with respect to the reference potential Vofs of the signal line 33 as seen from FIG. 5B.

Here, the threshold voltage of the organic EL element 21 is represented by Vthel, and the potential of the common power supply line 34, that is, the cathode potential, is represented by Vcath. At this time, if the second power supply potential Vini satisfies Vini<Vthel+Vcath, then since the source potential Vs of the driving transistor 22 becomes substantially equal to the low potential Vini, the organic EL element 21 is placed into a reversely biased state and stops the emission of light.

Figure 5A:
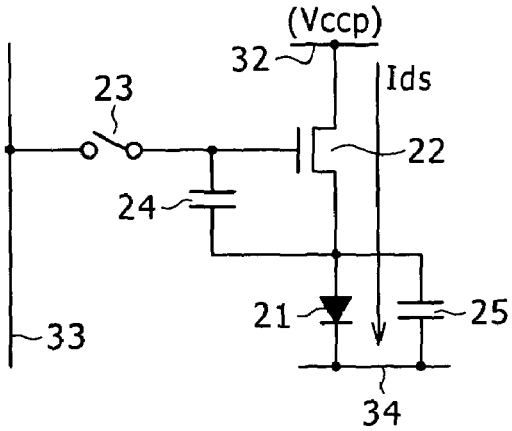
FIGS. 5A to 5D and 6A to 6D are circuit diagrams illustrating circuit operations of the organic EL display apparatus of FIG. 1.
Figure 5B:
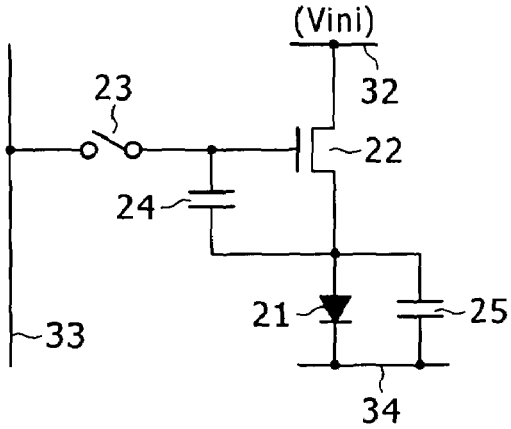
Figure 5C:
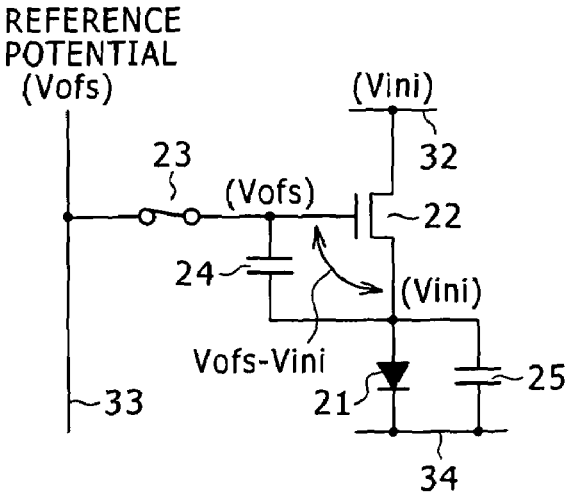

Then, when the potential WS of the scanning line 31 changes from the low potential side to the high potential side at time t2, the writing transistor 23 is placed into a conducting state as seen from FIG. 5C. At this time, since the reference potential Vofs is supplied from the signal outputting circuit 60 to the signal line 33, the gate potential Vg of the driving transistor 22 becomes the reference potential Vofs. Meanwhile, the source potential Vs of the driving transistor 22 is equal to the low potential Vini sufficiently lower than the reference potential Vofs.

At this time, the gate-source voltage Vgs of the driving transistor 22 is Vofs−Vini. Here, if Vofs−Vini is not sufficiently greater than the threshold potential Vth of the driving transistor 22, then a threshold value correction process hereinafter described cannot be carried out, and therefore, it is necessary to establish the potential relationship of Vofs−Vini>Vth.

In this manner, the process of fixing or finalizing the gate potential Vg of the driving transistor 22 to the reference potential Vofs and the source potential Vs of the driving transistor 22 to the low potential Vini to initialize them is a process of preparation (threshold value correction preparation) before a threshold value correction process hereinafter described is carried out. Accordingly, the reference potential Vofs and the low potential Vini become initialization potentials for the gate potential Vg and the source potential Vs of the driving transistor 22, respectively.

<Threshold Value Correction Period>

Figure 5D:
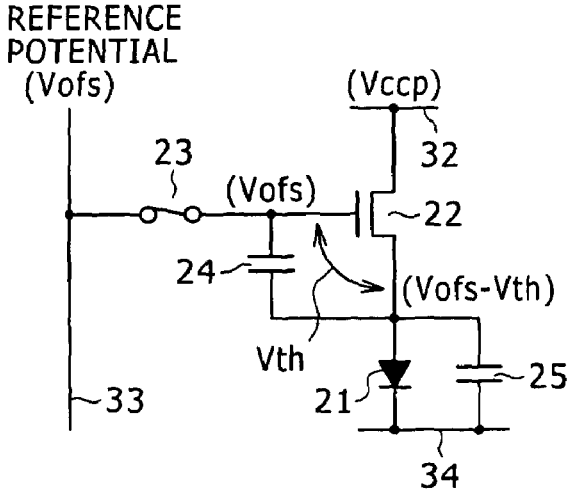

Then, if the potential DS of the power supply line 32 changes over from the low potential Vini to the high potential Vccp at time t3 as seen in FIG. 5D, then a threshold value correction process is started in a state wherein the gate potential Vg of the driving transistor 22 is maintained. In particular, the source potential Vs of the driving transistor 22 begins to rise toward the potential of the difference of the threshold potential Vth of the driving transistor 22 from the gate potential Vg.

For the convenience of description, the process of varying the source potential Vs toward the potential of the difference of the threshold potential Vth of the driving transistor 22 from the reference potential Vofs with reference to the reference potential Vofs at the gate electrode of the driving transistor 22 is hereinafter referred to as threshold value correction process. As the threshold value correction process progresses, the gate-source voltage Vgs of the driving transistor 22 soon converges to the threshold potential Vth of the driving transistor 22. The voltage corresponding to the threshold potential Vth is stored into the storage capacitor 24.

It is to be noted that, in order to allow, within a period within which the threshold value correction process is carried out, that is, within a threshold value correction period, current to wholly flow to the storage capacitor 24 side but not to flow to the organic EL element 21 side, the potential Vcath of the common power supply line 34 is set so that the organic EL element 21 has a cutoff state.

Figure 6A:
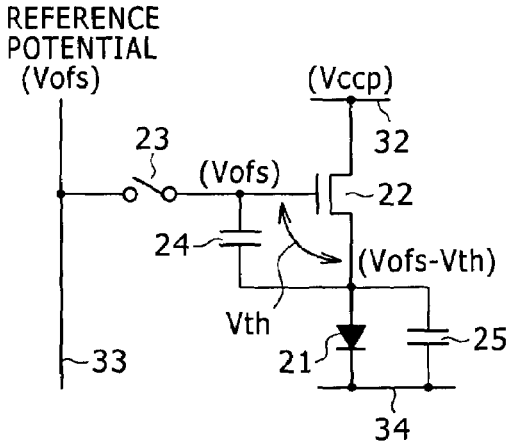

Then, the potential WS of the scanning line 31 changes to the low potential side at time t4, whereupon the writing transistor 23 is placed into a non-conducting state as seen in FIG. 6A. At this time, the gate electrode of the driving transistor 22 is electrically disconnected from the signal line 33 and enters a floating state. However, since the gate-source voltage Vgs is equal to the threshold potential Vth of the driving transistor 22, the driving transistor 22 remains in a cutoff state. Accordingly, drain-source current Ids does not flow to the driving transistor 22.

<Signal Writing & Mobility Correction Period>

Figure 6B:
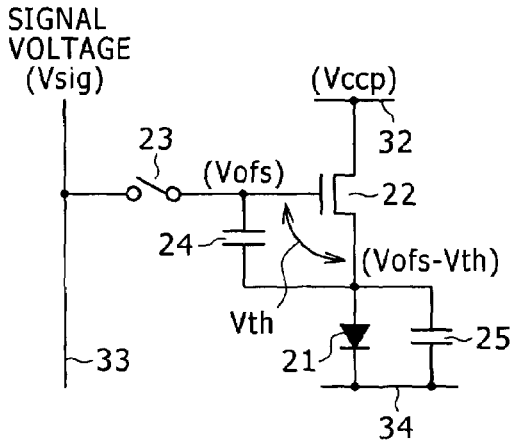
Figure 6C:
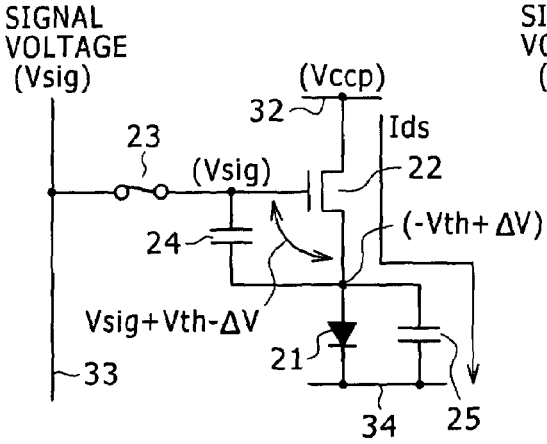

Then at time t5, the potential of the signal line 33 changes over from the reference potential Vofs to the signal voltage Vsig of the image signal as seen in FIG. 6B. Then at time t6, the potential WS of the scanning line 31 changes to the high potential side, wherein the writing transistor 23 is placed into a conducting state as seen in FIG. 6C to sample and write the signal voltage Vsig of the image signal into the pixel 20.

By the writing of the signal voltage Vsig by the writing transistor 23, the gate potential Vg of the driving transistor 22 becomes the signal voltage Vsig. Then, upon driving of the driving transistor 22 with the signal voltage Vsig of the image signal, the threshold potential Vth of the driving transistor 22 is canceled with the voltage corresponding to the threshold potential Vth stored in the storage capacitor 24. Details of the principle of the threshold value cancellation are hereinafter described in detail.

At this time, the organic EL element 21 remains in a cutoff state, that is, in a high-impedance state. Accordingly, current flowing from the power supply line 32 to the driving transistor 22 in response to the signal voltage Vsig of the image signal, that is, the drain-source current Ids, flows into the auxiliary capacitor 25. Consequently, charging of the auxiliary capacitor 25 is started.

By the charging of the auxiliary capacitor 25, the source potential Vs of the driving transistor 22 rises together with lapse of time. At this time, a dispersion of the threshold potential Vth of the driving transistor 22 for each pixel is canceled already, and the drain-source current Ids of the driving transistor 22 relies upon the mobility μ of the driving transistor 22.

Here, it is assumed that the ratio of the storage voltage Vgs of the storage capacitor 24 to the signal voltage Vsig of the image signal, that is, the write gain of the stored voltage Vgs is 1, which is an ideal value. In this instance, when the source potential Vs of the driving transistor 22 rises to the potential of Vofs−Vth+ΔV, the gate-source voltage Vgs of the driving transistor 22 becomes Vsig−Vofs+Vth−ΔV.

In particular, the rise amount ΔV of the source potential Vs of the driving transistor 22 acts so as to be subtracted from the voltage stored in the storage capacitor 24, that is, from Vsig−Vofs+Vth, or in other words, so as to discharge the accumulated charge of the storage capacitor 24, and therefore, is negatively fed back. Accordingly, the rise amount ΔV of the source potential Vs is a feedback amount in the negative feedback.

By applying negative feedback of the feedback amount ΔV in accordance with the driving current Ids flowing through the driving transistor 22 to the gate-source voltage Vgs, the dependency of the driving current Ids of the driving transistor 22 upon the mobility μ can be canceled. This cancellation process is a mobility correction process of correcting the dispersion of the mobility μ of the driving transistor 22 for each pixel.

More particularly, since the drain-source current Ids increases as the signal amplitude Vin (=Vsig−Vofs) of the image signal to be written into the gate electrode of the driving transistor 22 increases, also the absolute value of the feedback amount ΔV of the negative feedback increases. Accordingly, a mobility correction process in accordance with the emitted light luminance level is carried out.

Further, if it is assumed that the signal amplitude Vin of the image signal is fixed, then since also the absolute value of the feedback amount ΔV increases as the mobility μ of the driving transistor 22 increases, a dispersion of the mobility μ for each pixel can be removed. Accordingly, the feedback amount ΔV of the negative feedback can be regarded also as a correction amount of mobility correction. Details of the principle of the mobility correction are hereinafter described.

<Light Emitting Period>

Figure 6D:
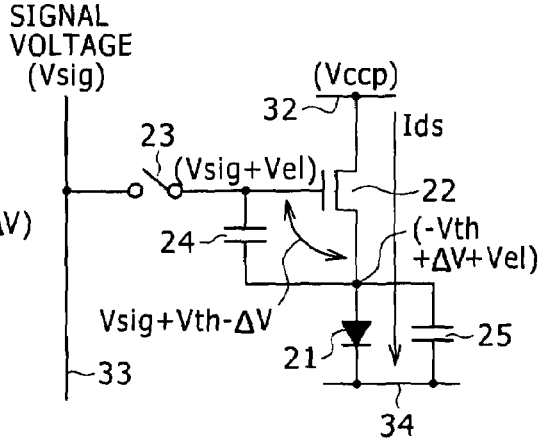

Then, the potential WS of the scanning line 31 changes to the low potential side at time t7, whereupon the writing transistor 23 is placed into a non-conducting state as seen from FIG. 6D. Consequently, the gate potential of the driving transistor 22 is placed into a floating state because it is electrically disconnected from the signal line 33.

Here, when the gate electrode of the driving transistor 22 is in a floating state, since the storage capacitor 24 is connected between the gate and the source of the driving transistor 22, also the gate potential Vg varies in an interlocked relationship with a variation of the source potential Vs of the driving transistor 22. An operation of the gate potential Vg of the driving transistor 22 which varies in an interlocked relationship with a variation of the source potential Vs in this manner is a bootstrap operation by the storage capacitor 24.

When the gate electrode of the driving transistor 22 is placed into a floating state and the drain-source current Ids of the driving transistor 22 simultaneously begins to flow to the organic EL element 21, the anode potential of the organic EL element 21 rises in response to the drain-source current Ids.

Then, when the anode potential of the organic EL element 21 exceeds Vthel+Vcath, driving current begins to flow to the organic EL element 21, and consequently, the organic EL element 21 starts emission of light. Further, the rise of the anode potential of the organic EL element 21 is nothing but a rise of the source potential Vs of the driving transistor 22. As the source potential Vs of the driving transistor 22 rises, also the gate potential Vg of the driving transistor 22 rises in an interlinked relationship by the bootstrap operation of the storage capacitor 24.

At this time, if it is assumed that the bootstrap gain is 1 in an ideal state, then the rise amount of the gate potential Vg is equal to the rise amount of the source potential Vs. Therefore, during the light emitting period, the gate-source voltage Vgs of the driving transistor 22 is kept fixed at Vsig−Vofs+Vth−ΔV. Then, at time t8, the potential of the signal line 33 changes over from the signal voltage Vsig of the image signal to the reference potential Vofs.

In a series of circuit operations described above, the processing operations of threshold value correction preparation, threshold value correction, writing of the signal voltage Vsig (signal writing) and mobility correction are executed with one horizontal scanning period (1 H). Meanwhile, the processing operations of signal writing and mobility correction are executed in parallel within the period from time t6 to time t7.

Principle of the Threshold Value Cancellation

Here, the principle of threshold value cancellation, that is, of the threshold value correction, is described. The driving transistor 22 operates as a constant current source because it is designed so as to operate in a saturation region. Consequently, the organic EL element 21 is supplied with fixed drain-source current or driving current Ids given by the following expression:

$$Ids=(1/2)\cdot\mu(W/L)Cox(Vgs-Vth)^2 \quad (1)$$

where W is the channel width of the driving transistor 22, L the channel length, and Cox the gate capacitance per unit area.

Figure 7:
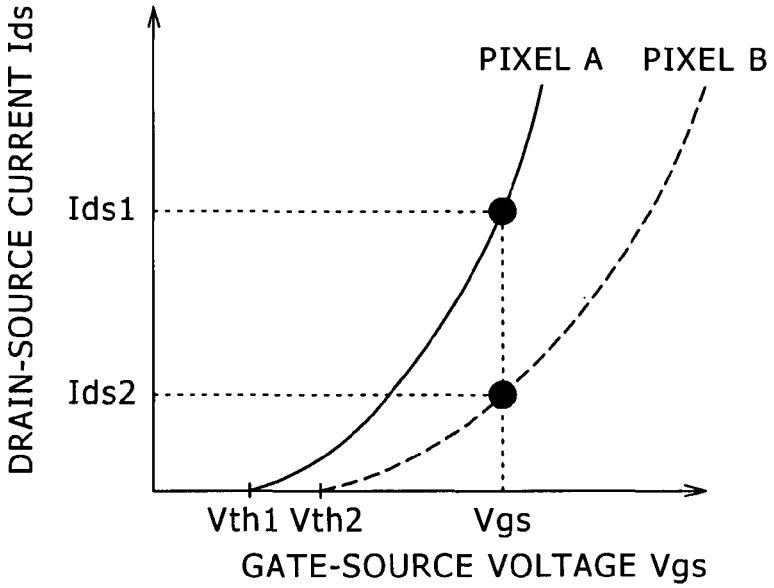
FIGS. 7 and 8 are characteristic diagrams illustrating a characteristic difference between pixels arising from a dispersion of a threshold voltage and a dispersion of a mobility of a driving transistor, respectively.

FIG. 7 illustrates a characteristic of the drain-source current Ids with respect to the gate-source voltage Vgs of the driving transistor 22.

As seen from the characteristic diagram of FIG. 7, if a cancellation process for a dispersion of the threshold potential Vth of the driving transistor 22 for each pixel is not carried out, then when the threshold potential Vth is Vth1, the drain-source current Ids corresponding to the gate potential Vg becomes Ids1.

In contrast, when the threshold potential Vth is Vth2 (Vth2>Vth1), the drain-source current Ids corresponding to the same gate-source voltage Vgs becomes Ids2 (Ids2<Ids1). In other words, if the threshold potential Vth of the driving transistor 22 varies, then even if the gate-source voltage Vgs is fixed, the drain-source current Ids varies.

On the other hand, in the pixel or pixel circuit 20, the gate-source voltage Vgs of the driving transistor 22 upon light emission is Vsig−Vofs+Vth−ΔV. Accordingly, by substituting this into the expression (1), the drain-source current Ids is represented by the following expression (2):

$$Ids=(1/2)\cdot\mu(W/L)Cox(Vsig-Vofs-\Delta V)^2 \quad (2)$$

In particular, the term of the threshold potential Vth of the driving transistor 22 is canceled, and the drain-source current Ids flowing from the driving transistor 22 to the organic EL element 21 does not rely upon the threshold potential Vth of the driving transistor 22. As a result, even if the threshold potential Vth of the driving transistor 22 varies for each pixel due to a dispersion of the fabrication process or aged deterioration of the driving transistor 22, the drain-source current Ids does not vary, and consequently, the emitted light luminance of the organic EL element 21 can be kept fixed.

Principle of the Mobility Correction

Figure 8:
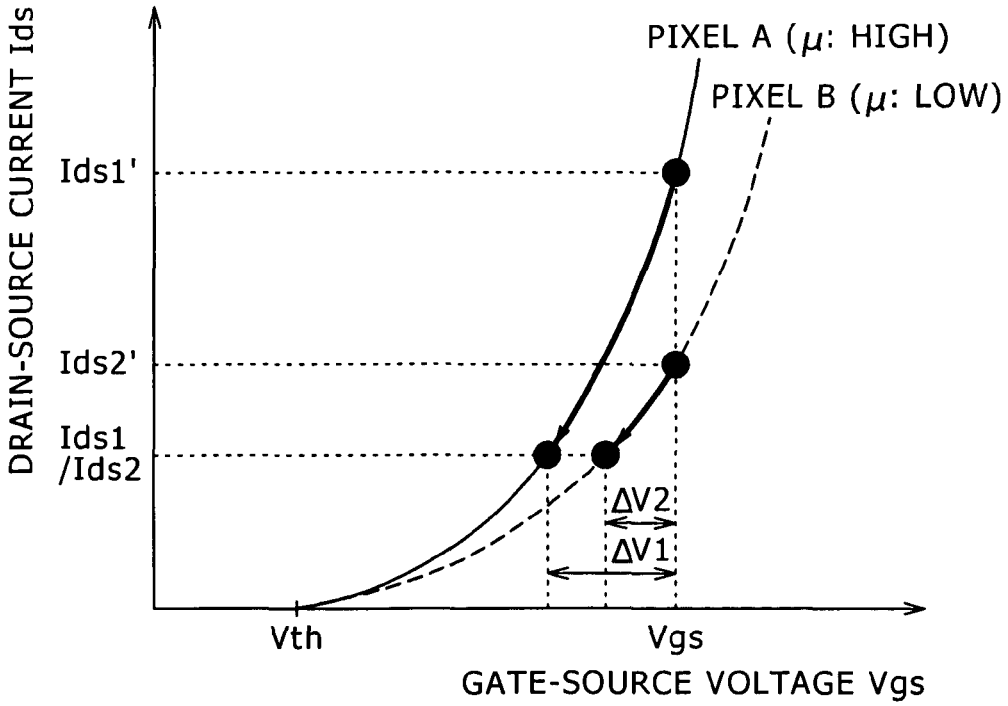

Now, the principle of the mobility correction of the driving transistor 22 is described. FIG. 8 illustrates characteristic curves of a pixel A whose driving transistor 22 has a relatively high mobility μ and a pixel B whose driving transistor 22 has a relatively low mobility μ for comparison. Where the driving transistor 22 is formed from a polycrystalline silicon thin film transistor or the like, it cannot be avoided that the mobility μ disperses among pixels like the pixel A and the pixel B.

It is assumed here that, in a state wherein the pixel A and the pixel B have a dispersion in mobility μ therebetween, the signal amplitudes Vin (=Vsig−Vofs) of an equal level are written into the gate electrodes of the driving transistors 22 in the pixels A and B. In this instance, if correction of the mobility μ is not carried out at all, then a great difference appears between the drain-source current Ids1' flowing through the pixel A having the high mobility μ and the drain-source current Ids2' flowing through the pixel B having the low mobility μ. If a great difference in the drain-source current Ids appears between different pixels originating from the dispersion of the mobility μ among the pixels in this manner, then uniformity of the screen image is damaged.

Here, as apparent from the transistor characteristic expression of the expression (1) given hereinabove, where the mobility μ is high, the drain-source current Ids is great. Accordingly, the feedback amount ΔV in the negative feedback increases as the mobility μ increases. As seen from FIG. 8, the feedback amount ΔV1 in the pixel A of the high mobility μ is greater than the feedback amount ΔV2 in the pixel B having the low mobility μ.

Therefore, if negative feedback is applied to the gate-source voltage Vgs with the feedback amount ΔV in accordance with the drain-source current Ids of the driving transistor 22 by the mobility correction process, then the negative feedback increases as the mobility μ increases. As a result, the dispersion of the mobility μ among the pixels can be suppressed.

In particular, if correction of the feedback amount ΔV1 is applied in the pixel A having the high mobility μ, then the drain-source current Ids drops by a great amount from Ids1' to Ids1. On the other hand, since the feedback amount ΔV2 in the pixel B having the low mobility μ is small, the drain-source current Ids decreases from Ids2' to Ids2 and does not drop by a great amount. As a result, the drain-source current Ids1 in the pixel A and the drain-source current Ids2 in the pixel B become substantially equal to each other, and consequently, the dispersion of the mobility μ among the pixels is corrected.

In summary, where the pixel A and the pixel B which are different in the mobility μ therebetween are considered, the feedback amount ΔV1 in the pixel A having the high mobility μ is greater than the feedback amount ΔV2 in the pixel B having the low mobility μ. In short, as the mobility μ increases, the feedback amount ΔV increases and the reduction amount of the drain-source current Ids increases.

Accordingly, if the negative feedback is applied to the gate-source voltage Vgs with the feedback amount ΔV in accordance with the drain-source current Ids of the driving transistor 22, then the current value of the drain-source current Ids is uniformed among the pixels which are different in the mobility μ from each other. As a result, the dispersion of the mobility μ among the pixels can be corrected. Thus, the process of applying negative feedback to the gate-source voltage Vgs of the driving transistor 22 with the feedback amount ΔV in accordance with the current flowing through the driving transistor 22, that is, with the drain-source current Ids, is the mobility correction process.

Here, a relationship between the signal voltage Vsig of the image signal and the drain-source current Ids of the driving transistor 22 depending upon whether or not threshold value correction and mobility correction are carried out in the pixel or pixel circuit 20 shown in FIG. 2 is described with reference to FIGS. 9A to 9C.

Figure 9A:
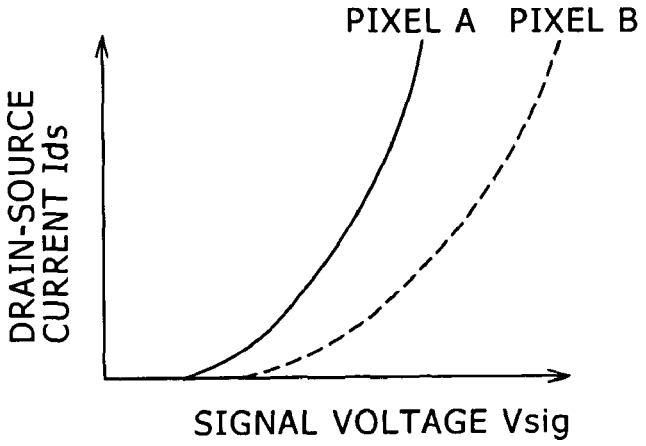
FIGS. 9A to 9C are characteristic diagrams illustrating relationships between a signal voltage of an image signal and drain-source current of the driving transistor depending upon whether or not threshold value correction and/or mobility correction are carried out.
Figure 9B:
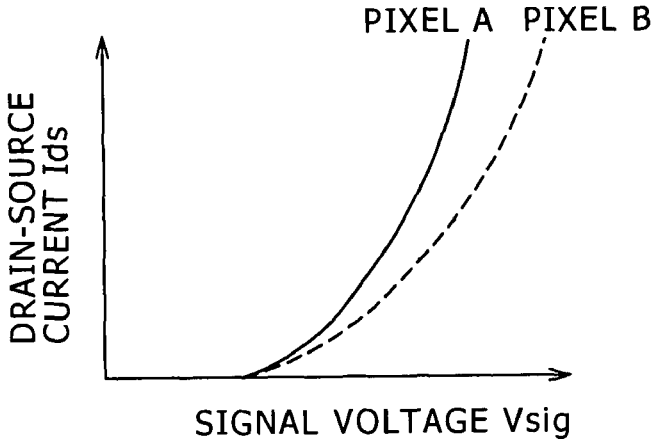
Figure 9C:
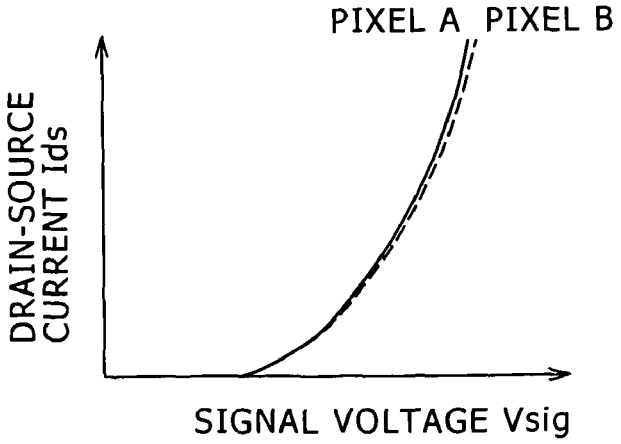

FIG. 9A illustrates the relationship in a case wherein none of the threshold value correction and the mobility correction is carried out, and FIG. 9B illustrates the relationship in another case wherein only the threshold value correction is carried out without carrying out the mobility correction while FIG. 9C illustrates the relationship in a further case wherein both of the threshold value correction and the mobility correction are carried out. As seen in FIG. 9A, when none of the threshold value correction and the mobility correction is carried out, the drain-source current Ids is much different between the pixels A and B arising from a dispersion of the threshold potential Vth and the mobility μ between the pixels A and B.

In contrast, where only the threshold value correction is carried out, although the dispersion of the drain-source current Ids can be reduced to some degree as seen in FIG. 9B, the difference in the drain-source current Ids between the pixels A and B arising from the dispersion of the mobility μ between the pixels A and B remains. Then, if both of the threshold value correction and the mobility correction are carried out, then the difference in the drain-source current Ids between the pixels A and B arising from the dispersion of the mobility μ for each of the pixels A and B can be almost eliminated as seen in FIG. 9C. Accordingly, at any gradation, a luminance dispersion among the organic EL elements 21 does not appear, and a display image of favorable picture quality can be obtained.

Further, since the pixel 20 shown in FIG. 2 has a function of a bootstrap operation by the storage capacitor 24 described hereinabove in addition to the correction functions for threshold value correction and mobility correction, the following operation and effects can be achieved.

In particular, even if the source potential Vs of the driving transistor 22 varies together with an aged change of the I-V characteristic of the organic EL element 21, the gate-source voltage Vgs of the driving transistor 22 can be kept fixed by a bootstrap operation by the storage capacitor 24. Accordingly, the current flowing through the organic EL element 21 does not vary but is fixed. As a result, since also the emitted light luminance of the organic EL element 21 is kept fixed, even if the I-V characteristic of the organic EL element 21 undergoes a secular change, image display which is free from luminance variation by the secular change can be achieved.

Bootstrap Gain Gb

In the foregoing description, it is assumed that the bootstrap gain Gb is in an ideal state, that is, Gb=100%. However, since the parasitic capacitance of the driving transistor 22 exists, the actual bootstrap gain Gb is not in the ideal state because of an influence of the parasitic capacitance, but is lower than 100%.

Here, where the capacitance values of the parasitic capacitance between the gate and the source and between the gate and the drain of the driving transistor 22 are represented by Cgs and Cgd, respectively, the capacitance value of the parasitic capacitance of the writing transistor 23 is represented by Cws and the capacitance value of the storage capacitor 24 is represented by Cs, the bootstrap gain Gb is given by the following expression (3):

$$Gb=(Cs+Cgs)/(Cs+Cgs+Cgd+Cws) \quad (3)$$

Since the parasitic capacitance at the gate electrode of the driving transistor 22, particularly the parasitic capacitance between the gate and the drain of the driving transistor 22, and the parasitic capacitance of the writing transistor 23 exist as can be recognized apparently from the expression (3), the bootstrap gain Gb is not in the ideal state and is lower than 1 (100%).

Variation of the Source Potential Vs in the Bootstrap Operation

Figure 10:
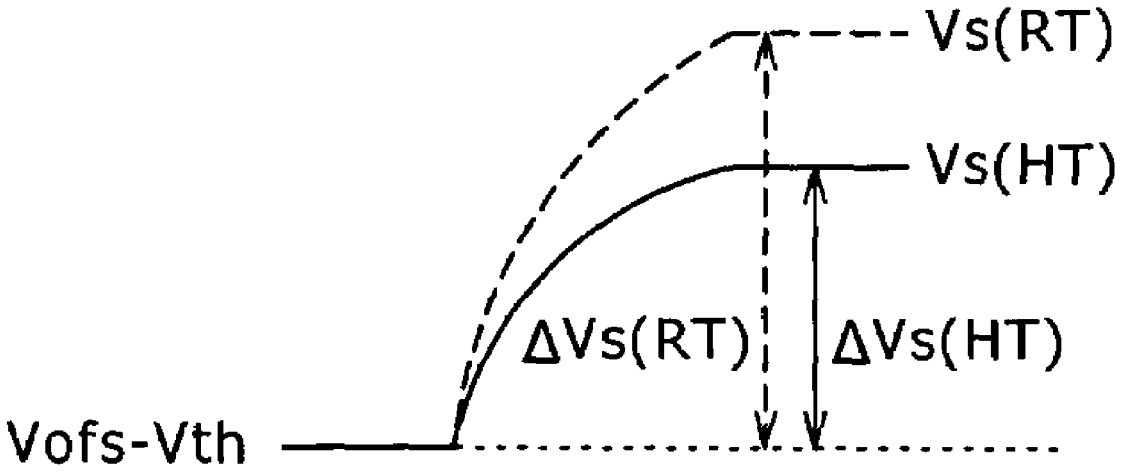
FIG. 10 is a waveform diagram illustrating a source voltage at normal temperature and another source voltage at a high temperature of the driving transistor.

Here, a variation of the source potential Vs of the driving transistor 22 in a bootstrap operation is studied. In FIG. 10, the source potential Vs(RT) at normal temperature, for example, at 25° C., is indicated by a broken line curve, and the source potential Vs(HT) at a high temperature, for example, at 60° C., is indicated by a solid line curve. Further, in FIG. 10, ΔV(RT) represents a variation amount of the source potential Vs(RT) at normal temperature, and ΔV(HT) represents a variation amount of the source potential Vs(HT) at the high temperature.

Figure 26:
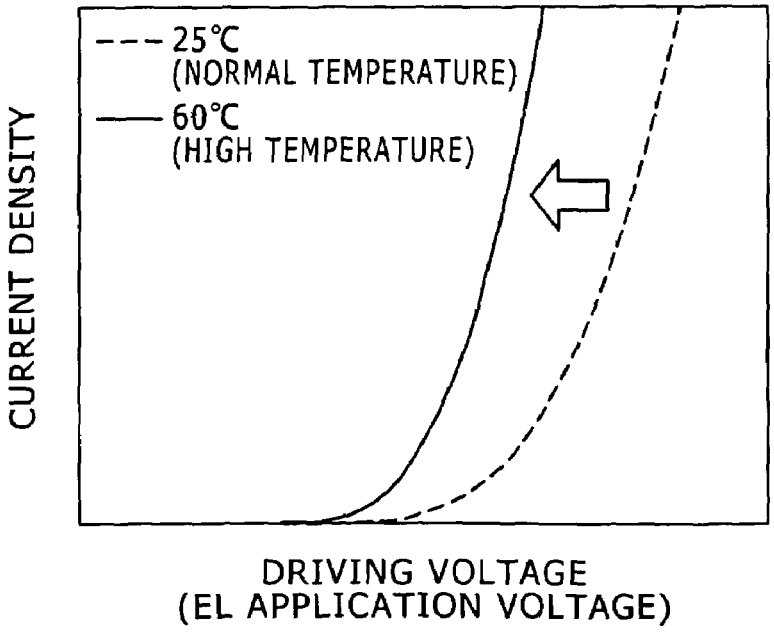
FIG. 26 is a diagrammatic view illustrating an example of a temperature characteristic of an organic EL element.

As described hereinabove, if the organic EL element 21 has a temperature characteristic and the temperature of the display panel 70, for example, rises by a variation or the like of the ambient temperature until a high temperature state is entered, then the rising edge of the characteristic curve becomes steep (refer to FIG. 26). Consequently, the driving voltage of the organic EL element 21 drops and the variation amount ΔVs of the source potential Vs of the driving transistor 22 decreases. Consequently, as apparently recognized from the expression (10) given hereinabove, the current Ids to flow to the driving transistor 22 increases.

Here, if the term of (1−Gb) in the expression (10) is 0, that is, if Gb=1, then the current Ids flowing through the driving transistor 22 is not influenced by the variation amount ΔVs of the source potential Vs. In other words, as the bootstrap gain Gb becomes higher, that is, as the ideal state of Gb=1 is approached, the variation of the current Ids with respect to the temperature variation of the display panel 70 can be improved.

Actually, however, the bootstrap gain Gb is not in the ideal state but is lower than 1 (100%) as described hereinabove. Accordingly, as the temperature of the display panel 70 rises, since the current Ids flowing to the driving transistor 22 increases, the emitted light luminance of the display panel 70 increases. In other word, as the temperature becomes higher than normal temperature, the luminance of the organic EL element 21 becomes excessively high under the same driving voltage.

Characteristic of the Embodiment

Therefore, the present embodiment adopts the following configuration in order to keep the emitted light luminance of the display panel 70 fixed without being influenced by the variation of the temperature of the display panel 70. In particular, the temperature of the display panel 70 is detected, and the mobility correction period, that is, the period for a mobility correction process, is controlled based on a result of the detection. Here, the mobility correction period can be regarded also as negative feedback period or time within which negative feedback is applied in the mobility correction process.

First, upon initialization where it is assumed that the display panel 70 is used at normal temperature such as 25° C., the mobility correction period t is set based on the following expression (5):

$$t=C(k\mu Vsig) \tag{5}$$

where k is a constant and is (1/2)(W/L)Cox, and C is the capacitance of a node which is discharged when the mobility correction is carried out and is, in the circuit example of FIG. 2, composite capacitance of the equivalent capacitance of the organic EL element 21, the storage capacitor 24 and the auxiliary capacitor 25.

The mobility correction period t is set commonly to all pixels. In the present embodiment, the mobility correction period t is controlled in response to the temperature of the display panel 70. In particular, when the temperature of the display panel 70, for example, rises and the emitted light luminance increases, the mobility correction period t is adjusted in a direction in which it increases. When the mobility correction period t increases, negative feedback to the potential difference between the gate and the source of the driving transistor 22 is applied for a longer period of time than that before the mobility correction period t is adjusted.

Consequently, the feedback amount ΔV in the mobility correction process increases in comparison with that in a case wherein the mobility correction period t has the initial value, that is, before the mobility correction period t is adjusted, and therefore, the mobility correction process is carried out in a direction in which the emitted light luminance is lowered. Then, the variation of the emitted light luminance arising from the variation, in the example described above, from the rise, is suppressed. As a result, since the emitted light luminance of the display panel 70 can be kept fixed without being influenced by the temperature variation of the display panel 70, a display image of good picture quality can be obtained.

In the following, a particular working example wherein the temperature of the display panel 70 is detected and the mobility correction period t is controlled based on a result of the detection is described.

Working Example

Figure 11:
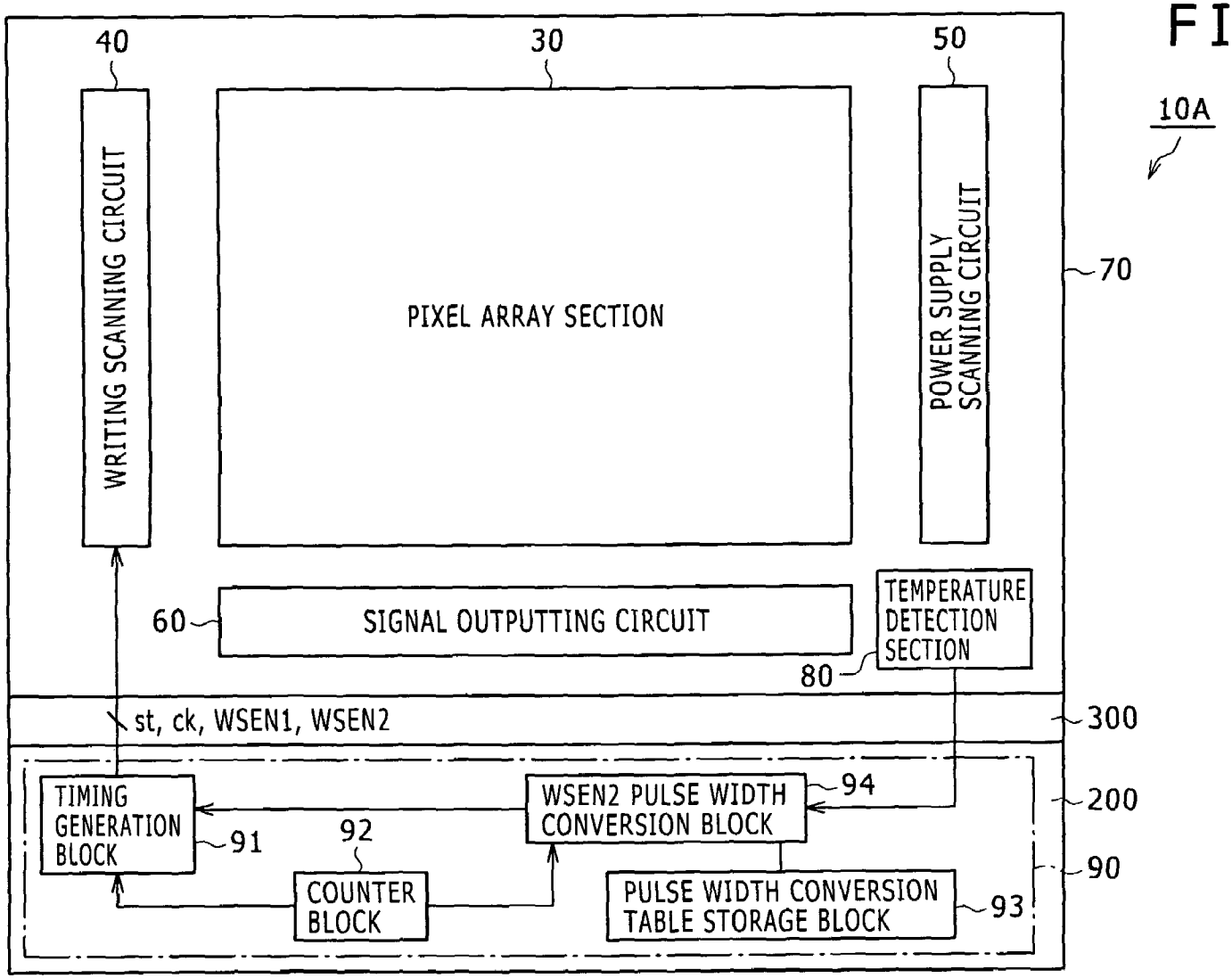
FIG. 11 is a block diagram showing a general system configuration of an organic EL display apparatus according to a working example of the present invention.

FIG. 11 shows a general system configuration of a organic EL display apparatus 10A according to a working example of the present invention.

Referring to FIG. 11, the organic EL display apparatus 10A shown includes a temperature detection section 80 for detecting the temperature of a display panel 70. The temperature detection section 80 may be formed, for example, from a temperature sensor such as a thermocouple which makes use of the Seebeck effect. The temperature detection section 80 is provided such that it is attached, for example, to the rear face side of the display panel 70 and detects the temperature of the display panel 70. It is to be noted that the arrangement position of the temperature detection section 80 is not limited to the rear face side of the display panel 70, but may be any position only if the temperature of the display panel 70 can be detected.

The organic EL display apparatus 10A includes, in addition to the temperature detection section 80, a control section 90 for controlling the mobility correction period based on a result of the detection by the temperature detection section 80. The control section 90 is provided on a control board 200 provided outside the display panel 70. The display panel 70 and the control board 200 are electrically connected to each other, for example, through a flexible board 300. While it is described here that the control section 90 is provided on the control board 200 provided outside the display panel 70, the control section 90 may naturally be provided on the display panel 70.

<Configuration of the Control Section>

The control section 90 includes a timing generation block 91, a counter block 92, a pulse width conversion table storage block 93 and a WSEN2 pulse width conversion block 94. The timing generation block 91 is a pulse production section which generates timing signals to be used for production of a writing scanning signal WS (WS1 to WSm) by the writing scanning circuit 40 such as a start pulse st, a clock pulse ck, and first and second enable pulses WSEN1 and WSEN. The first enable pulse WSEN1 (which may sometimes be represented as "WSEN1 pulse") principally defines the threshold value correction period. The second enable pulse WSEN2 (hereinafter referred to sometimes as "WSEN2 pulse") principally defines the signal writing and mobility correction period.

The counter block 92 provides a trigger signal to the timing generation block 91 and the WSEN2 pulse width conversion block 94 every time it counts a predetermined period, for example, one horizontal period. The pulse width conversion table storage block 93 stores a conversion table representative of a corresponding relationship between the temperature of the display panel 70 and the mobility correction period, more particularly a relationship between the temperature of the display panel 70 and the pulse width of the WSEN2 which defines the mobility correction period.

Figures 12, 13:
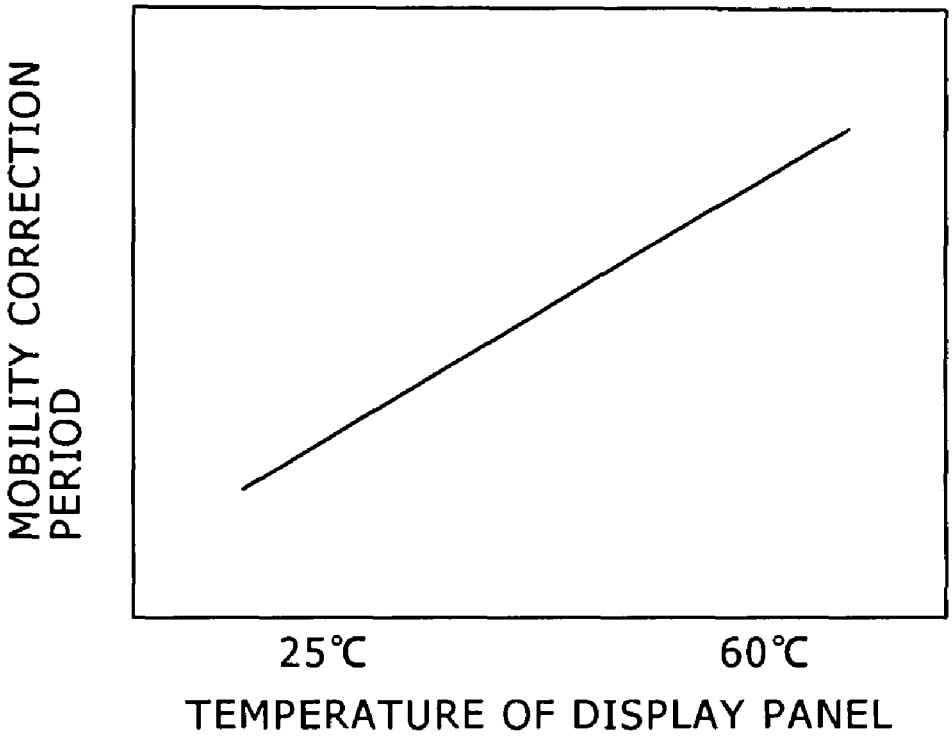
FIG. 12 is a diagrammatic view illustrating a relationship between the temperature of a display panel of the organic EL display apparatus of FIG. 11 and a mobility correction period for producing a conversion table.
FIG. 13 is a view illustrating an example of the conversion table.

Here, the conversion table is produced from a result of measurement of the temperature of the display panel 70 and the mobility correction period carried out in advance so that the emitted light luminance of the organic EL element 21 may be kept fixed as shown in FIG. 12. At this time, the conversion table has pulse width information of the WSEN2 pulse as a count value of the counter block 92 within a period from the timing of a rising edge to the timing of a falling edge of the WSEN2 pulse.

FIG. 13 illustrates an example of the conversion table stored in the pulse width conversion table storage block 93. Here, as an example, normal temperature is set to 25° C., and the pulse width of the WSEN2 pulse at this time is represented by C0. This pulse width C0 corresponds to the mobility correction period t in the initialization assuming that the organic EL display apparatus 10A is used at normal temperature of, for example, 25° C. Then, the pulse width when the temperature of the display panel 70 detected by the temperature detection section 80 is 0° C. is represented by C1, and the pulse width when the temperature is 10° C. is represented by C2. The relationship of the pulse widths is C0>C2>C1. Further, the pulse width at 40° C. is represented by C3, the pulse width at 60° C. is represented by C4 and the pulse width at 80° C. is represented by C5. The relationship of the pulse widths at this time is C5>C4>C3>C0.

The WSEN2 pulse width conversion block 94 uses the conversion table stored in the pulse width conversion table storage block 93 to control the mobility correction period based on a result of detection by the temperature detection section 80 and temperature information of the display panel 70. In particular, the WSEN2 pulse width conversion block 94 acquires pulse width information or time information of the WSEN2 pulse corresponding to the temperature information detected by the temperature detection section 80 from the conversion table and converts the pulse width of the WSEN2 pulse into the pulse width corresponding to the pulse width information.

More particularly, the WSEN2 pulse width conversion block 94 acquires temperature information of the display panel 70 from the temperature detection section 80 periodically, for example, after every one horizontal period or after every one field period based on a trigger signal from the counter block 92. Then, the WSEN2 pulse width conversion block 94 outputs, for example, if the detection temperature is 40° C., a count value corresponding to the pulse width C3 to the timing generation block 91 based on the conversion table stored in the pulse width conversion table storage block 93. Consequently, the timing generation block 91 generates a WSEN2 pulse of the pulse width C3 based on a count value supplied thereto from the WSEN2 pulse width conversion block 94. This WSEN2 pulse defines the pulse width of the writing scanning signal WS, that is, the signal writing and mobility correction period.

Figure 14:
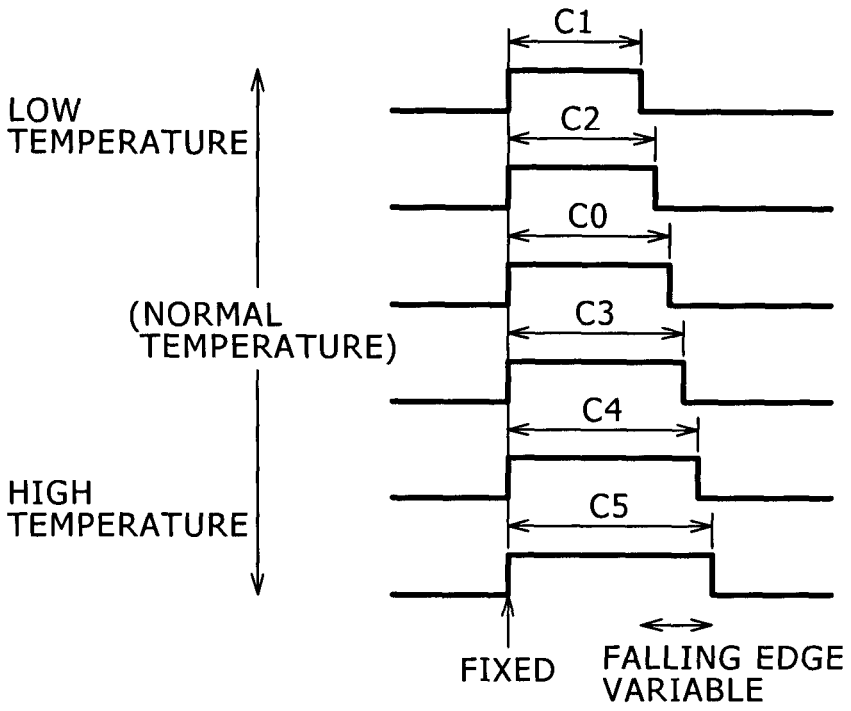
FIG. 14 is a waveform diagram illustrating a manner of conversion of the pulse width of a WSEN2 pulse used in the organic EL display apparatus of FIG. 11.

Here, when the pulse width of the WSEN2 pulse is to be converted, preferably the falling edge timing of the WSEN2 pulse is changed while the rising edge timing is fixed as seen from the waveform diagram of FIG. 14. This is because, where the rising edge timing of the WSEN2 pulse is fixed, the period from the end timing (t4) of the threshold value correction process to the start timing (t6) of signal writing in FIG. 4 can be fixed.

More particularly, since the light emitting period after the end timing (t7) of the mobility correction process is very long in comparison with the period from t4 to t6, even if the falling edge timing of the writing scanning signal WS varies and the light emitting period varies, the variation is very small in comparison with the entire light emitting period. Accordingly, even if the light emitting period varies by variation of the falling edge timing of the writing scanning signal WS, the influence of the variation of the mobility correction period upon the light emitting operation is as small as it can be ignored. On the other hand, since the period from t4 to t6 is very short in comparison with the light emitting period, the influence of the variation of the period from t4 to t6 by variation of the rising edge timing of the writing scanning signal WS upon the operation up to signal writing cannot be ignored.

From such a reason, preferably the falling edge timing of the WSEN2 pulse is changed while the rising edge is fixed. It is to be noted that this is a mere example and, even where the rising edge timing of the WSEN2 is varied, the effect provided by control of the mobility correction period based on the temperature of the display panel 70 can be achieved. In particular, the emitted light luminance of the display panel 70 can be kept fixed without being influenced by the variation of the temperature of the display panel 70.

<Configuration of the Writing Scanning Circuit>

Figure 15:
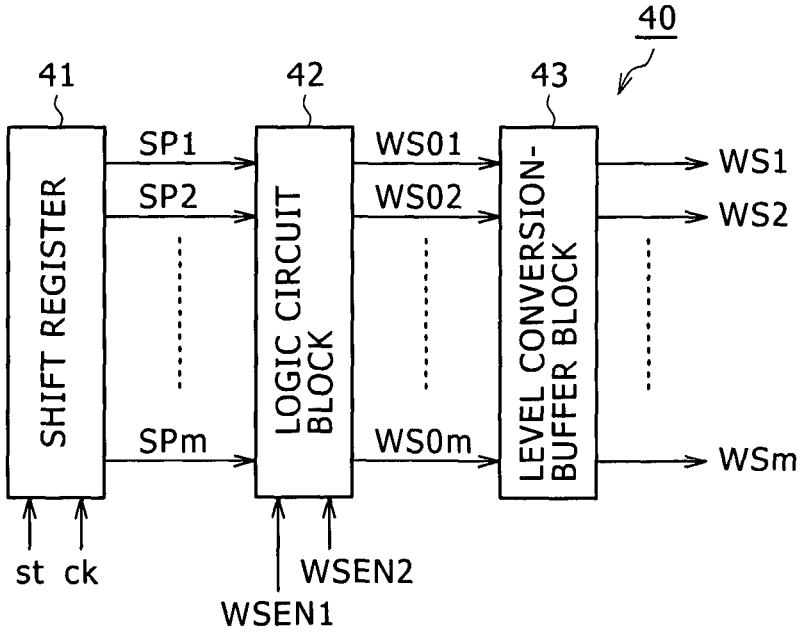
FIG. 15 is a block diagram showing an example of a configuration of a writing scanning circuit of the organic EL display apparatus of FIG. 11.

FIG. 15 shows an example of a configuration of the writing scanning circuit 40. Referring to FIG. 15, the writing scanning circuit 40 includes a shift register 41, a logic circuit block 42 and a level conversion-buffer block 43. The writing scanning circuit 40 receives a start pulse st, a clock pulse ck and first and second enable pulses WSEN1 and WSEN2 generated by the timing generation block 91 described hereinabove.

The start pulse st and the clock pulse ck are inputted to the shift register 41. The shift register 41 successively shifts or transfers the start pulse sp in synchronism with the clock pulse ck to output shift pulses SP1 to SPm from transfer stages or shift stages thereof.

Figure 16:
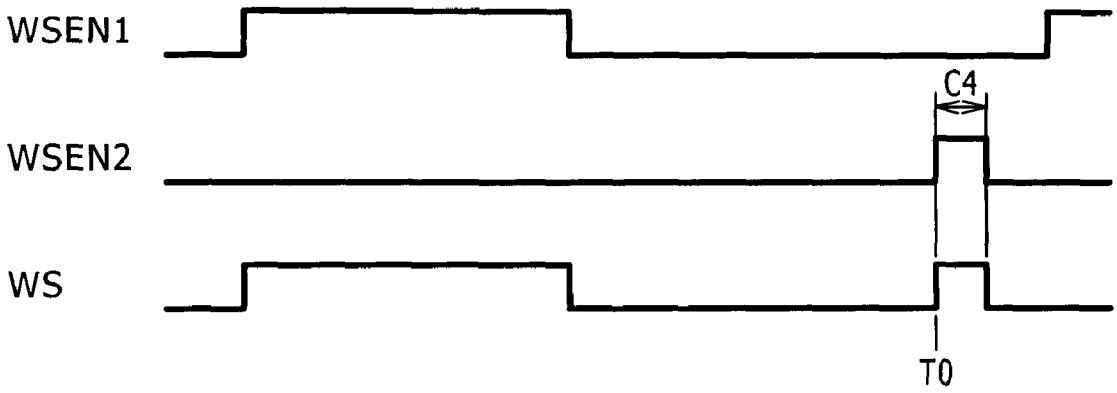
FIG. 16 is a timing chart illustrating a timing relationship of two enable pulses used in the organic EL display apparatus of FIG. 11.

The first and second enable pulses WSEN1 and WSEN2 are inputted to the logic circuit block 42. A timing relationship of the first and second enable pulses WSEN1 and WSEN2 is illustrated in FIG. 16. As seen from the timing waveform diagram of FIG. 16, the first enable pulse WSEN1 is a pulse signal generated at a front half of a 1 H period (one horizontal period) and having a relatively great pulse width. The second enable pulse WSEN2 is a pulse signal generated at a rear half of the 1 H period and having a relatively small pulse width.

The logic circuit block 42 outputs writing scanning signals WS01 to WS0*m* which have the pulse widths of the first and second enable pulses WSEN1 and WSEN2 at a front half portion and a rear half portion in synchronism with the shift pulses SP1 to SPm outputted from the shift register 41, respectively. The writing scanning signals WS01 to WS0*m* are converted so as to have a predetermined level or pulse height by the level conversion-buffer block 43 and are outputted as writing scanning signals WS1 to WSm to the pixel rows of the pixel array section 30.

As can be seen apparently from the circuit configuration of the writing scanning circuit 40, and as described hereinabove, the first enable pulse WSEN1 principally defines the threshold value correction period. Meanwhile, the second enable pulse WSEN2 principally defines the signal writing and mobility correction period. Then the mobility correction period can be adjusted by controlling the pulse width of the second enable pulse WSEN2 in response to the detection temperature of the display panel 70.

<Adjustment of the Mobility Correction Period>

Figure 17:
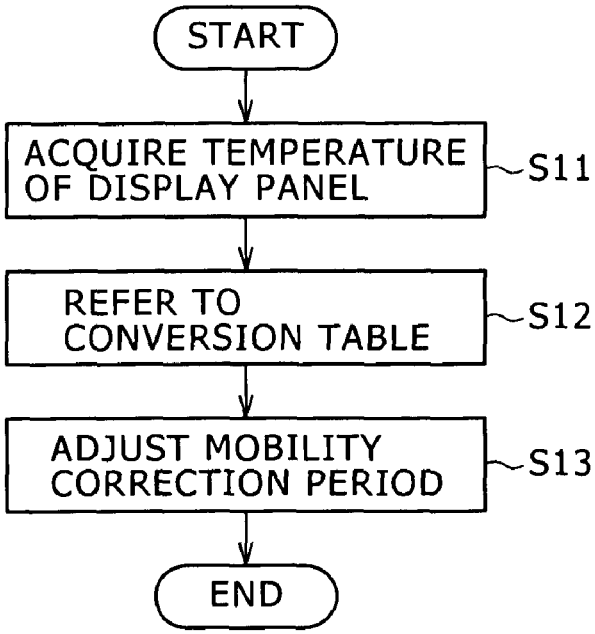
FIG. 17 is a flow chart illustrating an example of a processing procedure for adjusting the mobility correction period in the organic EL display apparatus of FIG. 11.

Now, the processing procedure for adjusting the mobility correction period which is executed under the control of the control section 90 having the configuration described above is described with reference to FIG. 17. It is to be noted that the present process is executed in a cycle of a predetermined period such as a one-horizontal period or a one-field period.

First, the control section 90 acquires a detection temperature of the temperature detection section 80, that is, a temperature of the display panel 70 at step S11. Then, the control section 90 refers to the conversion table stored in the pulse width conversion table storage block 93 to acquire pulse width information corresponding to the acquired temperature information at step S12. As described hereinabove, this pulse width information is a count value of the counter block 92, for example, from the rising edge timing to the falling edge timing of the second enable pulse WSEN2.

Then, the control section 90 supplies the pulse width information to the timing generation block 91 and controls the pulse width of the second enable pulse WSEN2 to adjust the mobility correction period at step S13. Here, adjustment of the pulse width of the second enable pulse WSEN2 to C4 is studied. At this time, the timing generation block 91 causes the WSEN2 pulse to rise at time T0 in FIG. 16 (which corresponds to time t6 of FIG. 4) and causes the WSEN2 pulse to fall at a count value with which the count value of the counter block 92 corresponds to the pulse width C4.

Modifications

While, in the foregoing description of the embodiment, the driving circuit of the organic EL element 21 is described hereinabove taking a case wherein the pixel basically includes two transistors including the driving transistor 22 and the writing transistor 23, the application of the present invention is not limited to this pixel configuration. In particular, an embodiment of the present invention can be applied also to a pixel configuration wherein control of light emission/no-light emission of the organic EL element 21 is carried out by changing over the power supply potential DS of the power supply line 32 for supplying driving current to the driving transistor 22.

Figure 18:
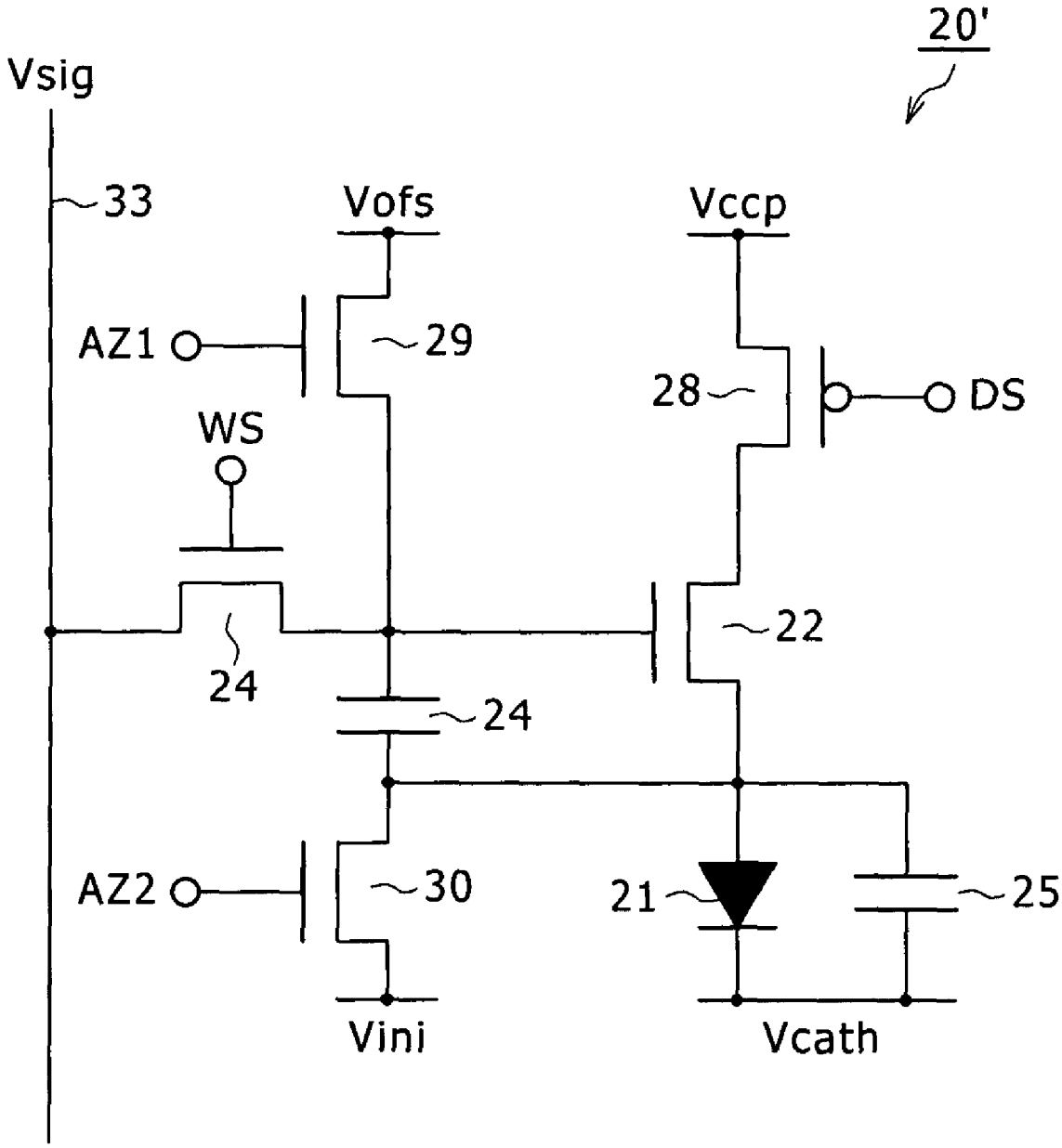
FIG. 18 is a circuit diagram showing another circuit configuration of a pixel.

As an example, such a pixel 20' as shown in FIG. 18 is known which includes five transistors including, in addition to a driving transistor 22 and a writing transistor 23, a light emission controlling transistor 26 and two switching transistors 27 and 28 as disclosed, for example, in Japanese Patent Laid-Open No. 2005-345722. Here, while a P-channel transistor is used for the light emission controlling transistor 26 and an N channel transistor is used for the switching transistors 27 and 28, an arbitrary combination of the conduction types may be used.

The light emission controlling transistor 26 is connected in series to the driving transistor 22 and selectively supplies the high potential Vccp to the driving transistor 22 to carry out control of light emission/no-light emission of the organic EL element 21. The switching transistor 27 selectively supplies the reference potential Vofs to the gate electrode of the driving transistor 22 to initialize the gate potential Vg to the reference potential Vofs. The switching transistor 28 selectively supplies the low potential Vini to the source electrode of the driving transistor 22 to initialize the source potential Vs to the low potential Vini.

Figure 19:
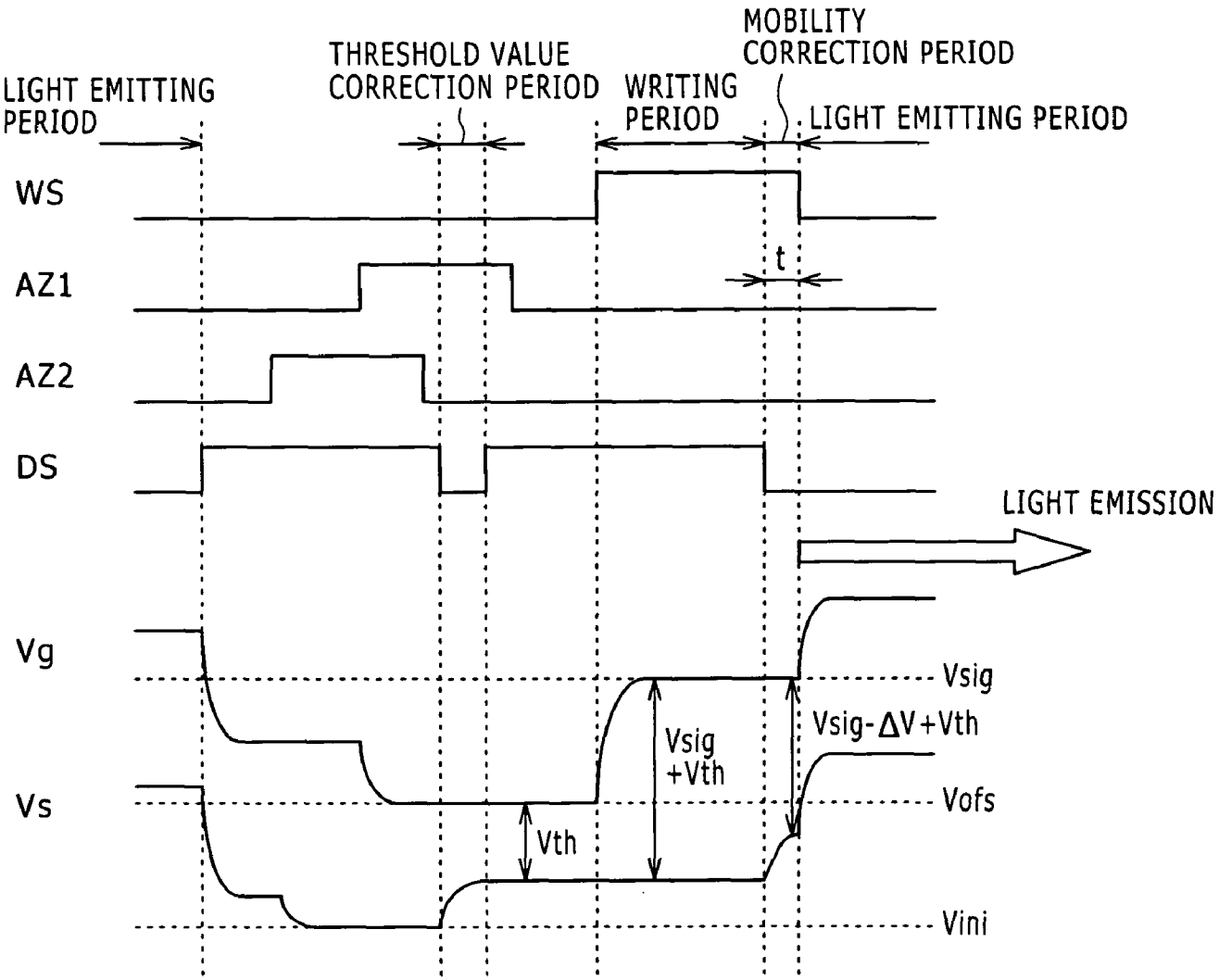
FIG. 19 is a timing waveform diagram where the pixel of FIG. 18 is used.

FIG. 19 illustrates timing waveforms in a case wherein the pixel 20' of the five-transistor configuration is used. In the timing waveform diagram, DS represents the selection signal of the light emission controlling transistor 26, AZI the control signal for the switching transistor 27, and AZ2 the control signal for the switching transistor 28.

As seen in the timing waveform diagram of FIG. 19, in the case of the pixel 20' of the five-transistor configuration, the period from the falling edge timing of the power supply potential DS to the falling edge timing of the writing scanning signal WS becomes the mobility correction period t. In other words, the mobility correction period t is defined by the changing timing of the power supply potential DS and the changing timing of the writing scanning signal WS. Accordingly, in order to achieve such operation and effects of the embodiment as described above, the falling edge timing of the writing scanning signal WS may be controlled in response to the detection temperature of the display panel 70 similarly as in the case of the embodiment described hereinabove.

Where the configuration which includes five transistors is taken as an example of another pixel configuration described above, various pixel configurations are possible such as a pixel configuration wherein the reference potential Vofs is supplied through the signal line 33 and is written by the writing transistor 23 while the switching transistor 27 is omitted.

Further, while, in the embodiment described above, a case wherein an embodiment of the present invention is applied to an organic EL display apparatus which includes an organic EL element as an electro-optical element of the pixel 20 is described as an example, an embodiment of the present invention is not limited to this application. In particular, the present invention can be applied to various display apparatus which use an electro-optical element or light emitting element of the current driven type whose emitted light luminance varies in response to the value of current flowing through the element such as an organic EL element, an LED element or a semiconductor laser element.

Applications

The display apparatus according to an embodiment of the present invention described above can be applied to display apparatus of electronic apparatus in various fields wherein an image signal inputted to the electronic apparatus or an image signal produced in the electronic apparatus is displayed as an image. In particular, the display apparatus according to an embodiment of the present invention can be applied as a display apparatus of such various electronic apparatus as shown in FIGS. 20 to 24A to 24G, for example, a digital camera, a notebook type personal computer, a portable terminal apparatus such as a portable telephone set and a video camera.

By using the display apparatus according to an embodiment of the present invention as a display apparatus for electronic apparatus in various fields in this manner, an image of high quality can be displayed on such various electronic apparatus. In particular, as apparent from the foregoing description of the embodiment of the present invention, since the display apparatus according to an embodiment of the present invention can keep the emitted light luminance of a display panel fixed to obtain a display image of high quality without being influenced by the variation of the temperature of the display panel, a display image of high quality can be obtained.

The display apparatus according to an embodiment of the present invention includes that of a module type of a sealed configuration. For example, the display apparatus may be a display module wherein a transparent opposing section of glass or the like is adhered to the pixel array section 30. Such a transparent opposing section as just mentioned may include a color filter, a protective film and so forth as well as such a light blocking film as described hereinabove. It is to be noted that the display module may include a circuit section, a flexible printed circuit (FPC) and so forth for inputting and outputting signals and so forth from the outside to the pixel array section or vice versa.

In the following, particular examples of the electronic apparatus to which an embodiment of the present invention is applied are described.

Figure 20:
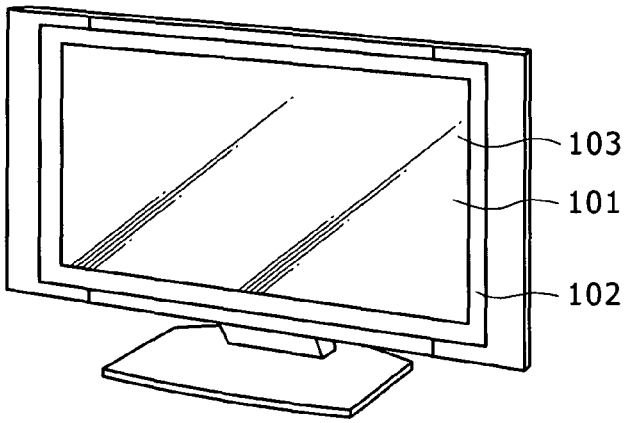
FIG. 20 is a perspective view showing an example of an appearance of a television set to which an embodiment of the present invention is applied.

FIG. 20 shows a television set to which an embodiment of the present invention is applied. Referring to FIG. 20, the television set shown includes a front panel 102 and an image display screen section 101 formed from a filter glass plate 103 and so forth and is produced using the display apparatus according to an embodiment of the present invention as the image display screen section 101.

Figure 21A:
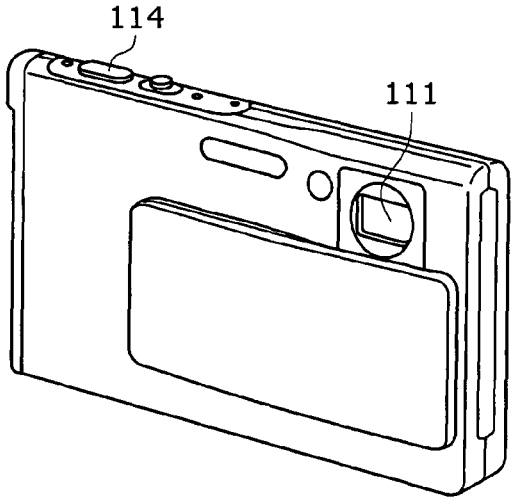
FIGS. 21A and 21B are perspective views showing an appearance of a digital camera to which an embodiment of the present invention is applied as viewed from the front side and the rear side, respectively.
Figure 21B:
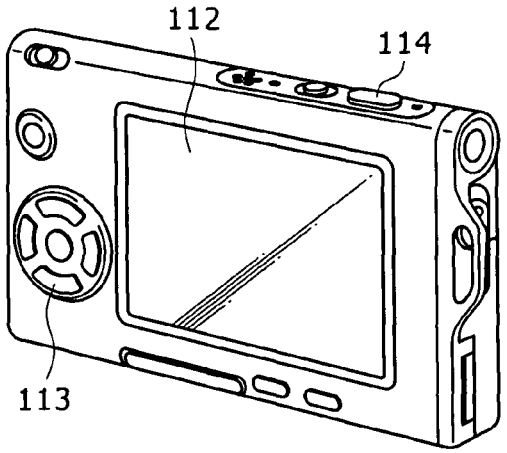

FIGS. 21A and 21B show an appearance of a digital camera to which an embodiment of the present invention is applied. Referring to FIGS. 21A and 21B, the digital camera shown includes a flash light emitting section 111, a display section 112, a menu switch 113, a shutter button 114 and so forth. The digital camera is produced using the display apparatus according to an embodiment of the present invention as the display section 112.

Figure 22:
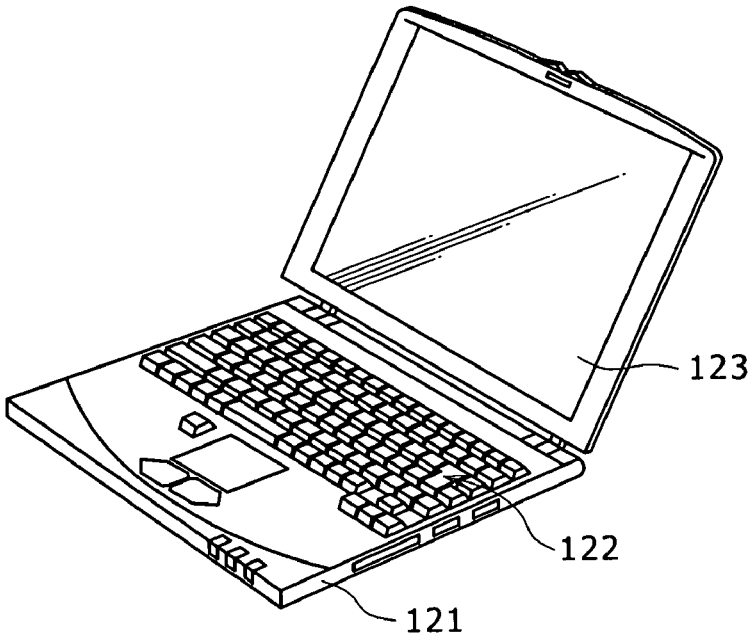
FIG. 22 is a perspective view showing an appearance of a notebook type personal computer to which an embodiment of the present invention is applied.

FIG. 22 shows an appearance of a notebook type personal computer to which an embodiment of the present invention is applied. Referring to FIG. 22, the notebook type personal computer shown includes a body 121, a keyboard 122 for being operated in order to input characters and so forth, a display section 123 for displaying an image and so forth. The notebook type personal computer is produced using the display apparatus according to an embodiment of the present invention as the display section 123.

Figure 23:
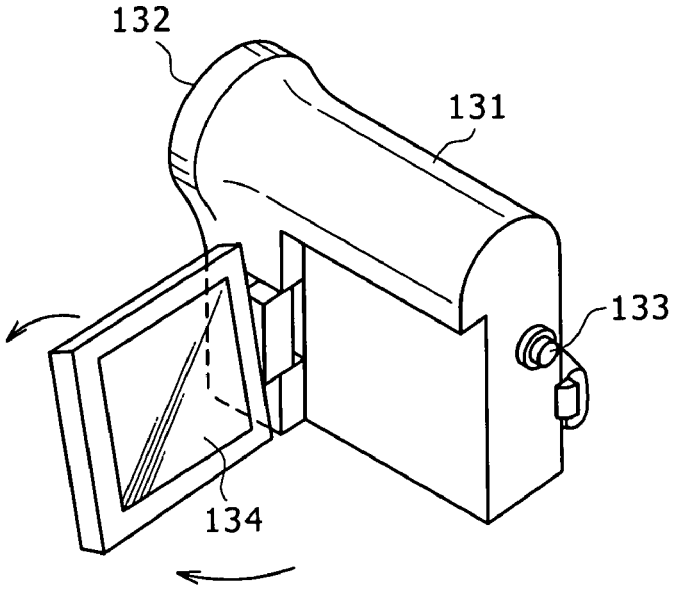
FIG. 23 is a perspective view showing an appearance of a video camera to which an embodiment of the present invention is applied.
Figure 24A:
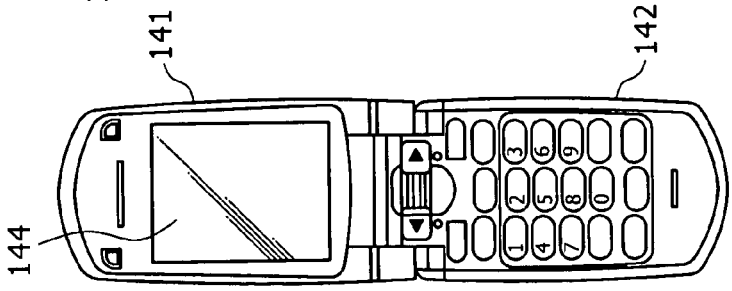
FIGS. 24A and 24B are a front elevational view and a side elevational view showing an appearance of a portable telephone set to which an embodiment of the present invention is applied in an unfolded state and FIGS. 24C, 24D, 24E, 24F and 24G are a front elevational view, a left side elevational view, a right side elevational view, a top plan view and a bottom plan view of the portable telephone set in a folded state, respectively.
Figure 24B:
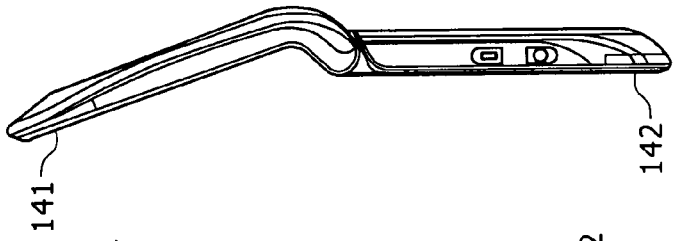
Figure 24D:
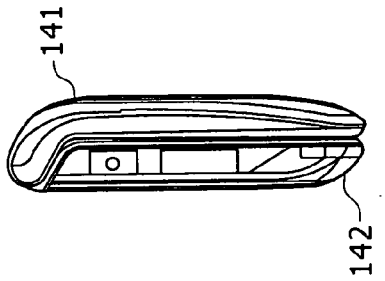
Figure 24C:
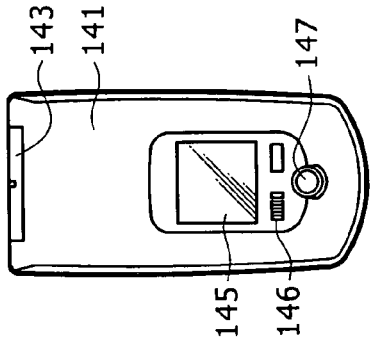
Figure 24E:
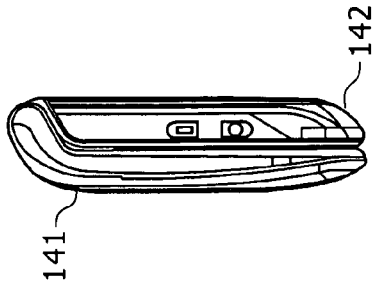
Figure 24F:
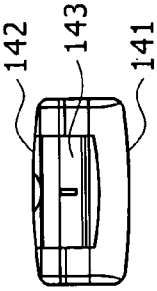
Figure 24G:
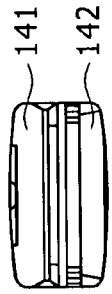
Figure 25:
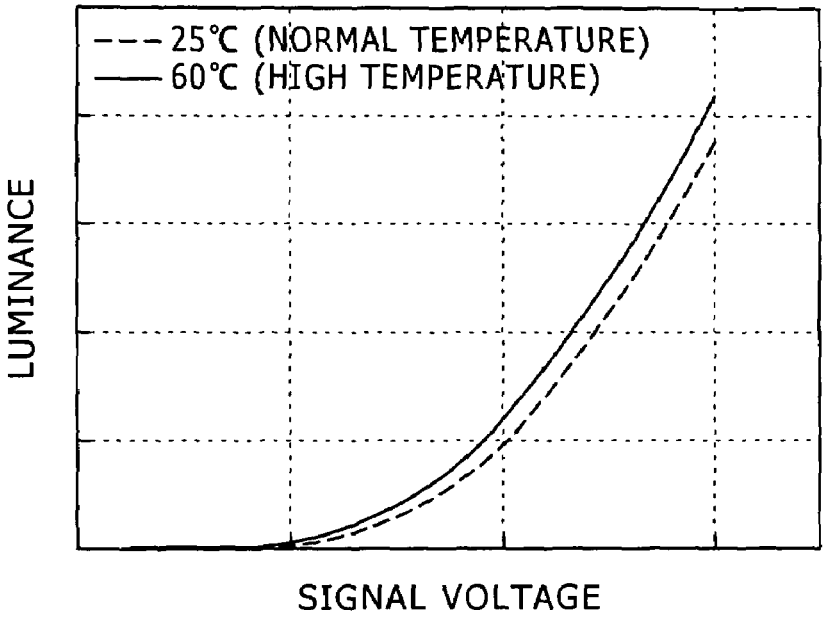
FIG. 25 is a diagrammatic view illustrating a signal voltage-emitted light luminance characteristic of a display panel.

FIG. 23 shows an appearance of a video camera to which an embodiment of the present invention is applied. Referring to FIG. 23, the video camera shown includes a body section 131, and a lens 132 for picking up an image of an image pickup object, a start/stop switch 133 for image pickup, a display section 134 and so forth provided on a face of the body section 131 which is directed forwardly. The video camera is produced using the display apparatus according to an embodiment of the present invention as the display section 134.

FIGS. 24A to 24G show an appearance of a portable terminal apparatus, for example, a portable telephone set, to which an embodiment of the present invention is applied. Referring to FIGS. 24A to 24G, the portable telephone set includes an upper side housing 141, a lower side housing 142, a connection section 143 in the form of a hinge section, a display section 144, a sub display section 145, a picture light 146, a camera 147 and so forth. The portable telephone set is produced using the display apparatus according to an embodiment of the present invention as the display section 144 or the sub display section 145.

The present application contains subject matter related to that disclosed in Japanese Priority Patent Application JP 2008-162738 filed in the Japan Patent Office on Jun. 23, 2008, the entire content of which is hereby incorporated by reference.

It should be understood by those skilled in the art that various modifications, combinations, sub-combinations and alterations may occur depending on design requirements and other factor in so far as they are within the scope of the appended claims or the equivalents thereof.

What is claimed is:

1. A display apparatus, comprising:

a display panel having a plurality of pixels arranged in a matrix thereon, each of said pixels including an electro-optical element, a writing transistor for writing an image signal, a driving transistor for driving said electro-optical element in response to the image signal written by said writing transistor, and a storage capacitor connected between the gate electrode and the source electrode of said driving transistor for storing the image signal written by said writing transistor, each of said pixels carrying out a mobility correction process for applying negative feedback to a potential difference between the gate and the source of said driving transistor with a correction amount determined from current flowing to said driving transistor;

a temperature detection section configured to detect the temperature of said display panel; and a control section configured to control the period of the mobility correction process based on a result of the detection by said temperature detection section.

2. The display apparatus according to claim 1, wherein said control section includes a pulse production section configured to produce a pulse signal which defines the period of the mobility correction process and varies the period of the mobility correction process by adjusting the pulse width of the pulse signal based on the result of the detection by said temperature detection section.

3. The display apparatus according to claim 2, wherein said control section varies the period of the mobility correction process by adjusting the changing timing of the pulse signal which defines an end timing of the period of the mobility correction process.

4. The display apparatus according to claim 2, wherein said control section includes a storage section configured to store a table representative of a corresponding relationship between the temperature of said display panel and the period of the mobility correction process and varies the period of the mobility correction process by acquiring period information corresponding to the temperature information detected by said temperature detection section from said table and adjusting the pulse width of the pulse signal based on the period information.

5. A driving method for a display apparatus which includes a display panel having a plurality of pixels arranged in a matrix thereon, each of said pixels including an electro-optical element, a writing transistor for writing an image signal, a driving transistor for driving said electro-optical element in response to the image signal written by said writing transistor, and a storage capacitor connected between the gate electrode and the source electrode of said driving transistor for storing the image signal written by said writing transistor, each of said pixels carrying out a mobility correction process for applying negative feedback to a potential difference between the gate and the source of said driving transistor with a correction amount determined from current flowing to said driving transistor, comprising the steps of:

detecting the temperature of said display panel; and controlling the period of the mobility correction process based on a result of the detection.

6. An electronic apparatus, comprising:

a display apparatus including a display panel having a plurality of pixels arranged in a matrix thereon, each of said pixels including an electro-optical element, a writing transistor for writing an image signal, a driving transistor for driving said electro-optical element in response to the image signal written by said writing transistor, and a storage capacitor connected between the gate electrode and the source electrode of said driving transistor for storing the image signal written by said writing transistor, each of said pixels carrying out a mobility correction process for applying negative feedback to a potential difference between the gate and the source of said driving transistor with a correction amount determined from current flowing to said driving transistor, a temperature detection section configured to detect the temperature of said display panel, and a control section configured to control the period of the mobility correction process based on a result of the detection by said temperature detection section.

7. The driving method according to claim 5, further comprising:

generating, by a pulse production section, a pulse signal which defines the period of the mobility correction process and varies the period of the mobility correction process by adjusting the pulse width of the pulse signal based on the result of the detection by said temperature detection section.

8. The driving method according to claim 7, further comprising:

controlling the period of the mobility correction process by adjusting the changing timing of the pulse signal which defines an end timing of the period of the mobility correction process.

9. The driving method according to claim 7, further comprising:

storing, by a storage section which is included in said control section, a table representative of a corresponding relationship between the temperature of said display panel and the period of the mobility correction process; and controlling, by said control section, the period of the mobility correction process by acquiring period information corresponding to the temperature information detected by said temperature detection section from said table and adjusting the pulse width of the pulse signal based on the period information.

10. The electronic apparatus according to claim 6, wherein said control section includes a pulse production section configured to produce a pulse signal which defines the period of the mobility correction process and varies the period of the mobility correction process by adjusting the pulse width of the pulse signal based on the result of the detection by said temperature detection section.

11. The electronic apparatus according to claim 10, wherein said control section varies the period of the mobility correction process by adjusting the changing timing of the pulse signal which defines an end timing of the period of the mobility correction process.

12. The electronic apparatus according to claim 10, wherein said control section includes a storage section configured to store a table representative of a corresponding relationship between the temperature of said display panel and the period of the mobility correction process and varies the period of the mobility correction process by acquiring period information corresponding to the temperature information detected by said temperature detection section from said table and adjusting the pulse width of the pulse signal based on the period information.

* * * * *